US011046409B2

(12) United States Patent
Wiegele et al.

(10) Patent No.: US 11,046,409 B2
(45) Date of Patent: Jun. 29, 2021

(54) MARINE OUTBOARD ENGINE COWLING

(71) Applicant: BRP US INC., Sturtevant, WI (US)

(72) Inventors: Dale A. Wiegele, Kenosha, WI (US); Darrell Wiatrowski, Libertyville, IL (US); John Charles Scott, Lake Villa, IL (US); Vincent Groleau, Sherbrooke (CA); Ivan Brousseau, Granby (CA)

(73) Assignee: BRP US INC.

( * ) Notice: Subject to any disclaimer, the term of this patent is extended or adjusted under 35 U.S.C. 154(b) by 0 days.

(21) Appl. No.: 16/723,245

(22) Filed: Dec. 20, 2019

(65) Prior Publication Data

US 2020/0198748 A1 Jun. 25, 2020

Related U.S. Application Data

(60) Provisional application No. 62/784,123, filed on Dec. 21, 2018.

(51) Int. Cl.

| | |
|---|---|
| ***B63H 20/32*** | (2006.01) |
| ***B63H 20/28*** | (2006.01) |
| ***F02B 61/04*** | (2006.01) |
| ***F02B 23/08*** | (2006.01) |
| ***F01P 3/20*** | (2006.01) |

(52) U.S. Cl.

CPC ..... *B63H 20/32* (2013.01); *B63H 20/28* (2013.01); *F01P 3/202* (2013.01); *F02B 23/08* (2013.01); *F02B 61/045* (2013.01)

(58) Field of Classification Search

CPC ..... B63H 20/32; B63H 20/28; F01P 3/202; F02B 23/08; F02B 61/045

See application file for complete search history.

(56) References Cited

U.S. PATENT DOCUMENTS

| | | | |
|---|---|---|---|
| 2,549,485 | A | 4/1951 | Kiekhaefer et al. |
| 2,756,736 | A | 7/1956 | Kiekhaefer et al. |
| 3,358,668 | A | 12/1967 | Post et al. |
| 3,750,615 | A | 8/1973 | Haft et al. |
| 3,773,010 | A | 11/1973 | Elingsen |
| 3,955,526 | A | 5/1976 | Kusche |
| 4,348,194 | A | 9/1982 | Walsh |
| 4,379,702 | A | 4/1983 | Takada et al. |
| 4,571,193 | A | 2/1986 | Takada et al. |
| 4,600,396 | A | 7/1986 | Crane et al. |
| 4,698,037 | A | 10/1987 | Watanabe et al. |

(Continued)

*Primary Examiner* — Stephen P Avila

(74) *Attorney, Agent, or Firm* — BCF LLP

(57) ABSTRACT

A marine outboard engine includes an internal combustion engine assembly that includes an internal combustion engine, a fuse assembly, a fuel filter, a spark plug, a gearcase including one of a propeller and an impeller, a swivel bracket, and a cowling. The cowling includes a service panel disposed on a first lateral side of the internal combustion engine assembly, and an affixed panel disposed on a second lateral side of the internal combustion engine assembly. The service and affixed panels define a split line therebetween and are removably attached to each other. The fuse assembly, the fuel filter, and the spark plug are mounted to one of the first lateral side and the affixed panel proximate to the split line and are at least in part accessible from the first lateral side when the service panel is detached and removed from the affixed panel.

25 Claims, 12 Drawing Sheets

(56) References Cited

U.S. PATENT DOCUMENTS 4,708,673 A * 11/1987 Dunham ..... F02B 61/045 123/195 C
4,723,927 A 2/1988 Walsh et al.
4,860,703 A 8/1989 Boda et al.
4,867,120 A 9/1989 Boda et al.
4,869,693 A 9/1989 Curtis et al.
4,952,180 A 8/1990 Watanabe et al.
4,968,276 A 11/1990 Hashimoto
5,025,763 A 6/1991 Watanabe
5,052,960 A 10/1991 Kato
5,052,961 A 10/1991 Uchida et al.
5,328,395 A 7/1994 Oishi
5,407,372 A 4/1995 Mondek et al.
5,472,361 A 12/1995 Fujimoto et al.
5,487,687 A 1/1996 Idzikowski et al.
5,489,227 A 2/1996 Ishida et al.
5,803,777 A 9/1998 Hiraoka
5,873,755 A 2/1999 Takahashi et al.
5,938,491 A 8/1999 Kawai et al.
6,017,254 A 1/2000 Katayama et al.
6,048,236 A 4/2000 Natsume
6,074,258 A 6/2000 Arai et al.
6,099,371 A 8/2000 Nozawa et al.
6,106,342 A 8/2000 Kameoka
6,132,273 A 10/2000 Nakayama et al.
6,227,921 B1 5/2001 Feehan
6,287,161 B1 9/2001 Nozawa
6,302,749 B1 10/2001 Tawa et al.
6,390,865 B1 5/2002 Kameoka
6,439,938 B1 8/2002 Katayama
6,488,552 B2 12/2002 Kitsu et al.
6,663,450 B1 12/2003 Walczak et al.
6,669,517 B1 12/2003 Alby et al.
6,682,379 B1 1/2004 Walczak et al.
6,821,170 B2 11/2004 Sanschagrin et al.
6,846,211 B2 1/2005 Yasuda et al.
6,875,066 B2 4/2005 Wolaver
6,878,022 B2 4/2005 Yasuda et al.
6,910,929 B2 6/2005 Yasuda et al.
6,991,500 B1 1/2006 Gulko et al.
7,044,098 B2 5/2006 Amano et al.
7,118,432 B2 10/2006 Katayama
7,140,933 B2 11/2006 Nakamura et al.
7,163,428 B2 1/2007 Sanschagrin
7,210,973 B2 5/2007 Sanschagri et al.
7,217,166 B2 5/2007 Fukuoka et al.
7,247,064 B2 7/2007 Nakamura
7,249,985 B2 7/2007 Fukuoka et al.
7,320,630 B2 1/2008 Nakamura
7,364,485 B2 4/2008 Kameoka
7,401,598 B2 7/2008 Ochiai
7,425,163 B2 9/2008 Murai et al.
7,455,560 B2 11/2008 Arai et al.
7,540,794 B2 6/2009 Inoue et al.
7,621,791 B2 11/2009 Yazaki et al.
9,073,616 B1 7/2015 Wiegele et al.
10,161,168 B1 * 12/2018 VanRuiswyk ..... B63H 20/32
10,293,763 B2 * 5/2019 Nola ..... B60R 13/0838
2006/0172631 A1 8/2006 Kameoka
2006/0258235 A1 11/2006 Kimura et al.
2008/0023923 A1 1/2008 Kameyama et al.
2009/0318038 A1 12/2009 Hasegawa et al.
2010/0147257 A1 6/2010 Yazaki et al.

* cited by examiner

MARINE OUTBOARD ENGINE COWLING

CROSS-REFERENCE

The present application claims priority from U.S. Provisional Patent Application No. 62/784,123, filed Dec. 21, 2018, the entirety of which is incorporated herein by reference.

TECHNICAL FIELD

The present invention relates to cowlings for marine outboard engines.

BACKGROUND

A marine outboard engine includes a cowling which covers the engine and other internal components so as to help prevent them from being exposed to water and other exterior elements. The cowling covers at least part of the engine's exhaust system and other components located between the engine and the gearcase.

A marine outboard engine also includes components that need to be serviced, such as spark plugs, filters, and fuses, as well as components that do not, such as an Engine Management Module (EMM) for controlling engine operation and a throttle body. The cowling typically provides for some way of being at least in part disassembled to expose the engine components for servicing. Depending on each particular design of the cowling and depending on each particular design of the engine that the cowling covers, the servicing of the engine's components can be more or less difficult.

SUMMARY

It is an object of the present technology to ameliorate at least some of the inconveniences present in the prior art.

The developers of the present technology have observed that while some engine components require more frequent inspection and maintenance than other engine components, in prior art marine outboard engines, placement of the former engine components relative to the engine block in combination with the particular design of prior art cowlings makes at least some of these components relatively difficult to inspect, service and/or replace.

Furthermore, the developers of the present technology have observed that, in at least some prior art marine outboard engines, removing a part of the cowling to gain access to the components requiring more frequent inspections/service also exposes other components that may not require inspection or servicing. The developers of the present technology have further observed that some such other components, such as the EMM and the throttle body of the engine, may be relatively sensitive and should only be inspected and adjusted by skilled technicians, and therefore needlessly exposing these components should be discouraged.

In view of the above, the developers of the present technology have designed a cowling that allows for relatively easy access to engine components that typically require more frequent inspection and service while keeping other, more sensitive engine components, covered and out of sight. The cowling according to the present technology discourages "needless" access to at least some of the engine's more sensitive engine components by making these components more difficult to access.

More particularly, the cowling provides two panels that mate along a split line. The split line extends vertically along at least parts of the front and rear portions of the two panels and horizontally along at least parts of the top portions of the two panels. A first one of the panels is affixed to and covers one lateral side of the engine assembly with panel-to-engine-assembly connectors. Engine components of the marine outboard engine are positioned relative to the engine assembly such that the first panel covers those of the components to which access is discouraged. A second one of the panels is received on and covers the other lateral side of the engine assembly. Due to the positioning of the engine components, the second panel covers those of the components that require relatively more frequent inspections/service.

Unlike the first panel, the second panel is not directly attached to the engine assembly and is instead attached to the first panel via one or more panel-to-panel connectors. The second panel is therefore easier to remove from the engine assembly than the first panel. When the second panel is detached and removed from the first panel, the first panel remains attached to the engine and thereby maintains the components to which access is discouraged out of view of the person(s) servicing the engine. If required, the first panel can be removed from the engine assembly by taking additional steps which include removing panel-to-engine-assembly connectors.

According to one aspect of the present technology, there is provided a marine outboard engine comprising: an internal combustion engine assembly comprising an internal combustion engine and having a front, a back, a top, a first lateral side, and a second lateral side; an electrical system operatively connected to the internal combustion engine to operate the internal combustion engine, the electrical system comprising a fuse assembly; a fuel filter operatively connected to the internal combustion engine to supply fuel to the internal combustion engine from an external fuel tank; a spark plug connected to the internal combustion engine; a gearcase including one of a propeller and an impeller operatively connected to the internal combustion engine assembly; a swivel bracket operatively connected to the internal combustion engine assembly; and a cowling at least partially covering the internal combustion engine assembly.

In some embodiments, the cowling includes: a service panel disposed on the first lateral side of the internal combustion engine assembly and engaging the first lateral side via at least one first damping member that positions the service panel relative to the first lateral side, and an affixed panel disposed on the second lateral side of the internal combustion engine assembly and engaging the second lateral side via at least one second damping member that positions the affixed panel relative to the second lateral side, the service and affixed panels defining a split line therebetween and being removably attached to each other by a panel-to-panel connector.

In some embodiments, the fuse assembly, the fuel filter, and the spark plug are all mounted to one of: the first lateral side of the internal combustion engine assembly, and the affixed panel proximate to the split line, so as to be at least in part accessible from the first lateral side of the internal combustion engine when the service panel is detached and removed from the affixed panel with the affixed panel remaining on the second lateral side of the internal combustion engine.

In some embodiments, the fuse assembly comprises fuses and relays.

In some embodiments, the internal combustion engine assembly further comprises an exhaust housing attached to and extending downward from the internal combustion engine to the gearcase.

In some embodiments, the affixed panel is further connected to the internal combustion engine assembly via a panel-to-engine-assembly connector.

In some embodiments, the panel-to-engine-assembly connector is a resilient connector; the internal combustion engine includes an engine block; and the resilient connector is removably attached to one of: a component of the internal combustion engine, the engine block, the exhaust housing, and the gearcase.

In some embodiments, the resilient connector is a rubber cord having first and second end portions and a mid portion extending between the first and second end portions; part of the second end portion has a first diameter; the mid portion has a second diameter; the first diameter is larger than the second diameter; the first end portion is fixed to the affixed panel; the second end portion is removably received in one of a recess and an aperture defined in the one of: the component of the internal combustion engine, the engine block, the exhaust housing, and the gearcase; the first diameter is larger than a diameter of the second recess; and the resilient connector is in tension.

In some embodiments, the resilient connector is a first resilient connector of a plurality of resilient connectors; the plurality of resilient connectors includes: a first resilient connector attached to a front side of the internal combustion engine assembly, and a second resilient connector attached to the back of the internal combustion engine assembly.

In some embodiments, the internal combustion engine further includes: a cylinder block, and a cylinder head connected to the cylinder block, the cylinder head and the cylinder block defining a cylinder therebetween; the spark plug is received in a corresponding aperture defined in the cylinder head and extends in part into the cylinder; a vertical bank plane defines a bank angle of the cylinder block relative to a vertical longitudinal center plane of the marine outboard engine, the vertical bank plane passing through a central axis of the cylinder; and the spark plug is disposed at least in part between the vertical bank plane and the service panel.

In some embodiments, the marine outboard engine further includes an ignition coil operatively connected to the spark plug, the ignition coil is mounted to one of the first lateral side of the internal combustion engine assembly, and the affixed panel proximate to the split line.

In some embodiments, the service panel and the affixed panel each include an air intake aperture in a top portion thereof and a baffle; the internal combustion engine has an air intake; and the baffles define a tortuous air path between each baffle and the respective service panel and the affixed panel, the tortuous air path guiding air from the air intake aperture toward the air intake of the internal combustion engine.

In some embodiments, the marine outboard engine further includes a first baffle attached to the service panel and a second baffle attached to the affixed panel. In some such embodiments, the first and second baffles are disposed on opposite sides of a vertical longitudinal center plane of the internal combustion engine and extend from the top of the internal combustion engine to the back of the internal combustion engine; the service panel defines a first air intake aperture in a top portion thereof; the affixed panel defines a second air intake aperture in a top portion thereof; the internal combustion engine has an air intake; the first baffle defines a first portion of a tortuous air path between the first baffle and the service panel, the first portion of the tortuous air path guiding air from the first air intake aperture toward the air intake of the internal combustion engine; and the second baffle defines a second portion of the tortuous air path between the second baffle and the affixed panel. In some such embodiments, the second portion of tortuous air path guides air from the second air intake aperture downward, along the back of internal combustion engine assembly.

In some embodiments, the internal combustion engine further includes: a cylinder block, and a cylinder head connected to the cylinder block, the cylinder head and the cylinder block defining a cylinder therebetween; the spark plug is received in a corresponding aperture defined in the cylinder head and extends in part into the cylinder; the cylinder head is angularly offset from a vertical longitudinal center plane of the marine outboard engine by a bank angle; and the bank angle is selected such that a majority of the cylinder head is disposed on a same side of the vertical longitudinal center plane as the service panel.

In some embodiments, the marine outboard engine further includes an engine cooling circuit thermostat, an engine cooling circuit blow off valve, an ignition coil, a starter motor, and a vapor separator. In some such embodiments, the engine cooling circuit thermostat, the engine cooling circuit blow off valve, the ignition coil, the starter motor, and the vapor separator are operatively connected to the internal combustion engine and mounted to one of the first lateral side of the internal combustion engine assembly, and the affixed panel proximate to the split line.

In some embodiments, the marine outboard engine further includes a fuel injector operatively connected to the internal combustion engine and mounted to the first lateral side of the internal combustion engine assembly.

In some embodiments, the electrical system comprises an Engine Management Module (EMM); the marine outboard engine further comprises a throttle body operatively connected to the internal combustion engine; and at least one of the EMM and the throttle body is disposed on the second lateral side between the internal combustion engine and the affixed panel.

In some embodiments, the marine outboard engine further includes a tilt-trim system coupled to the swivel bracket for adjusting a tilt-trim angle of the internal combustion engine, an Engine Management Module (EMM) operatively connected to the tilt-trim system to operate the tilt-trim system, the EMM being part of the electrical system, and a tilt-trim button operatively connected to the EMM for operating the tilt-trim system via the EMM. In some such embodiments, the tilt-trim button is on an outer side of the affixed panel.

In some embodiments, the marine outboard engine further includes battery terminals operatively connected to a starter motor of the internal combustion engine assembly for connecting a battery thereto. In some such embodiments, the battery terminals are on an outer side of the affixed panel.

According to one aspect of the present technology, there is provided a marine outboard engine that includes an internal combustion engine assembly comprising and internal combustion engine and having a front, a back, a top, a first lateral side, and a second lateral side; an electrical system operatively connected to the internal combustion engine to operate the internal combustion engine, the electrical system comprising battery terminals for connecting an external battery to the electrical system; a gearcase including one of a propeller and an impeller operatively connected to the internal combustion engine assembly; a swivel bracket operatively connected to the internal combustion engine and coupled to a tilt-trim system for adjusting a tilt-trim angle of the internal combustion engine; a tilt-trim button operatively connected to the tilt-trim system to operate the tilt-trim system; and a cowling at least partially covering the internal combustion engine.

In some such embodiments, the cowling includes: a service panel disposed on the first lateral side of the internal combustion engine assembly and engaging the first lateral side via at least one first damping member, and an affixed panel disposed on the second lateral side of the internal combustion engine assembly and engaging the second lateral side via at least one second damping member, the service and affixed panels defining a split line therebetween and being removably attached to each other by a connector. In some such embodiments, the battery terminals are at least one of disposed on an outer side of the affixed panel, mounted to the first lateral side of the internal combustion engine assembly and mounted to the affixed panel proximate the split line. In some such embodiments, the tilt-trim button is disposed on an outer side of the affixed panel.

In some embodiments, the marine outboard engine further includes a lubricant reservoir mounted to the internal combustion engine assembly, a lubricant hose fluidly connected at one end to the lubricant reservoir, and a lubricant filler cap assembly fluidly connected to another end of the lubricant hose. In some such embodiments, the lubricant filler cap assembly is attached to the affixed panel.

In some embodiments, the marine outboard engine further includes a fuse assembly, a fuel filter, and a spark plug, the fuse assembly being part of the electrical system, the fuel filter being operatively connected to the internal combustion engine to supply fuel to the internal combustion engine from an external fuel tank, the spark plug being connected to the internal combustion engine. In some such embodiments, the fuse assembly and the fuel filter are mounted to one of: the first lateral side of the internal combustion engine assembly, and the affixed panel proximate to the split line; and the spark plug is mounted to the first lateral side of the internal combustion engine assembly.

In some embodiments, the marine outboard engine further includes a fuel supply hose operatively connected via one end to the internal combustion engine for supplying fuel to the internal combustion engine, and at least one communication wire operatively connected via one end to the EMM. In some such embodiments, the fuel supply hose and the at least one communication wire is at least one of attached to the outer side of the affixed panel, mounted to the first lateral side of the internal combustion engine assembly and mounted to the affixed panel proximate the split line.

In some embodiments, the affixed panel includes a rigging panel that stays with the affixed panel when the service panel is detached and removed from the affixed panel, and a rigging grommet bracket attached to the rigging panel. In some such embodiments, another end of the fuel supply hose is received through a first aperture defined through the rigging grommet bracket; and another end of the at least one communication wire is attached to the rigging grommet bracket.

In some embodiments, the marine outboard engine further includes a gearcase lubricant reservoir fluidly connected to a cavity defined in the gearcase, the cavity containing a lubricant. In some such embodiments, the at least a part of the gearcase lubricant reservoir is one of: transparent and translucent; the gearcase lubricant reservoir is attached to the affixed panel; and at least the part of the gearcase lubricant reservoir is visible when the service panel is detached and removed from the affixed panel with the affixed panel remaining on the second lateral side of the internal combustion engine.

In some embodiments, the cowling further comprises a top cap covering a top portion of the service panel and a top portion of the affixed panel.

In some embodiments, the cowling further comprises a rear seam cover covering at least in part the split line.

The foregoing examples are non-limiting.

For purposes of this application, terms related to spatial orientation such as forward, rearward, upward, downward, left, and right, should be understood in a frame of reference where the propeller position corresponds to a rear of the marine outboard engine and where the outboard engine is oriented such that its driveshaft extends vertically. Terms related to spatial orientation when describing or referring to components or sub-assemblies of the engine separately from the engine should be understood as they would be understood when these components or sub-assemblies are mounted to the engine, unless specified otherwise in this application.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
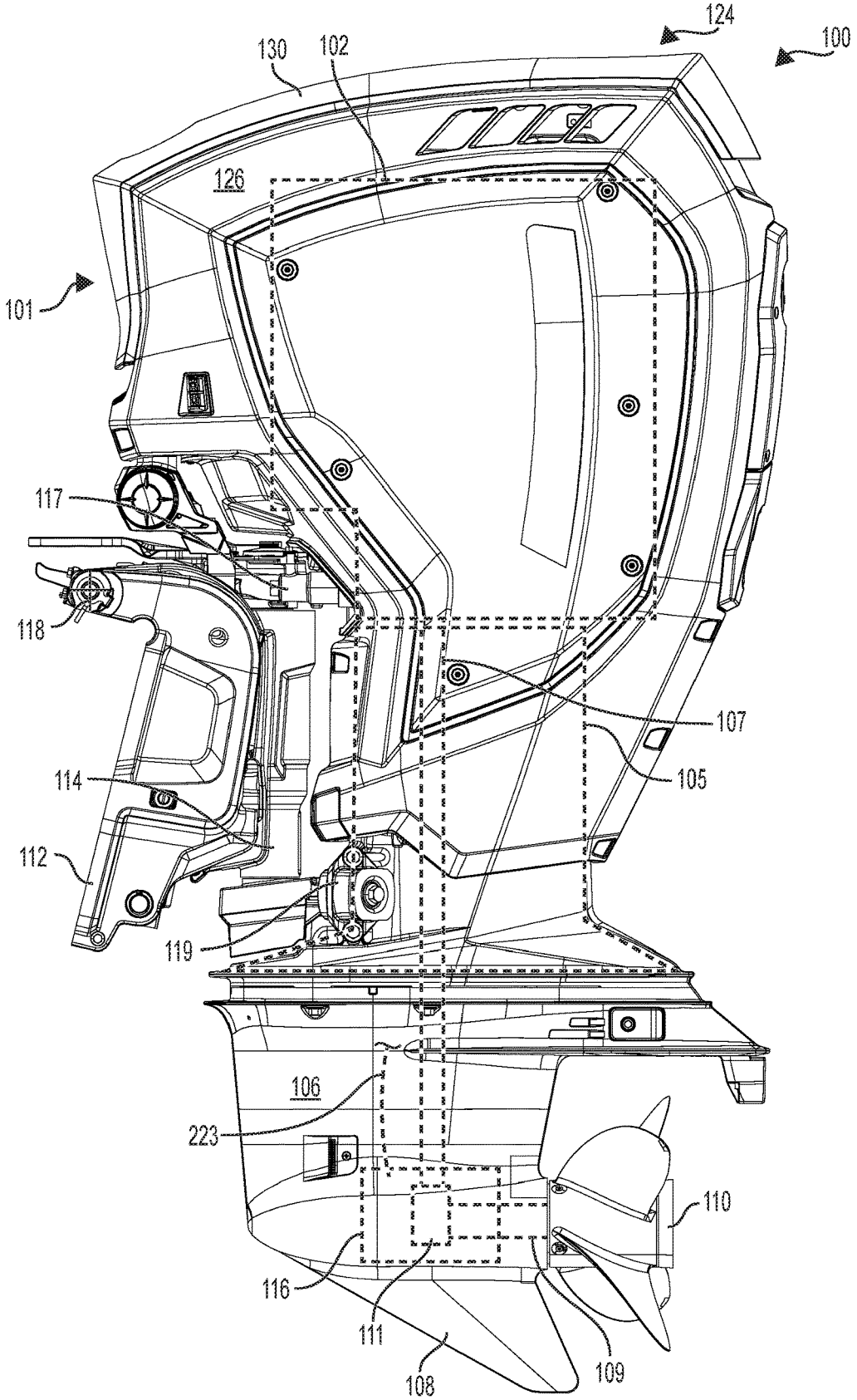
FIG. 1 is a left side elevation view of a marine outboard engine.

Referring to FIG. 1, a marine outboard engine 100 includes an internal combustion engine assembly 101 for powering and propelling the marine outboard engine 100. The internal combustion engine assembly 101 includes an internal combustion engine 102, an exhaust housing 105, a gearcase 106, and a propeller 110.

The exhaust housing 105, which can be sometimes known as a driveshaft housing, an exhaust casing, or an upper casing, extends downward from the internal combustion engine 102 to the gearcase 106. In the present embodiment, the exhaust housing 105 houses, inter alia, a driveshaft 107. The driveshaft 107 connects a crankshaft 115 (FIG. 3) of the internal combustion engine 102 to a transmission 111 disposed in a lubricant-containing cavity 116 defined in the gearcase 106. It is contemplated that the driveshaft 107 could be disposed outside of the exhaust housing 105. It is contemplated that the element connecting the internal combustion engine 102 to the gearcase 106, in the present embodiment the exhaust housing 105, could define no exhaust conduits therethrough. It is also contemplated that the exhaust housing 105, or other element used instead of the exhaust housing 105 to connect the gearcase 106 to the internal combustion engine 102, could be made of multiple parts. It is also contemplated that additional parts, such as an exhaust plate or an exhaust guide could be disposed between the exhaust housing 105 and the internal combustion engine 102.

The gearcase 106 includes a propeller shaft 109 connected at a front end thereof to the transmission 111. A skeg 108 extends from a bottom of the gearcase 106. It is contemplated that the marine outboard engine 100 could have any other transmission. The rear end of the propeller shaft 109 extends rearward out of the gearcase 106. The propeller 110 is mounted onto the rear end of the propeller shaft 109 for propelling the marine outboard engine 100. It is contemplated that the marine outboard engine 100 could have a jet drive with a gearcase having an impeller (not shown) instead of the propeller 110.

The marine outboard engine 100 further includes a stern bracket 112 and a swivel bracket 114 that are used to mount the internal combustion engine assembly 101 to a watercraft. The stern bracket 112 is attachable to a stern (not shown) of the watercraft and can take various forms, the details of which are conventionally known. The internal combustion engine assembly 101 is pivotably connected to the swivel bracket 114 via upper engine mounts 117 and lower engine mounts 119 to pivot about a vertical steering axis (not shown). This allows for steering of the marine outboard engine 100 and the watercraft to which it is attached. It is contemplated that any other mechanism could be used for mounting the marine outboard engine 100 onto a watercraft.

The swivel bracket 114 is pivotably connected to the stern bracket 112 to pivot relative to the stern bracket 112 about a horizontal tilt-trim axis 118. Briefly referring to FIG. 6, the stern bracket 112 and the swivel bracket 114 are coupled to a tilt-trim system 120, the details of which are known. The tilt-trim system 120 is connected to a pair of tilt-trim buttons 121 via which the tilt-trim system 120 can be controlled to adjust a tilt-trim angle of the internal combustion engine 102. The electrical connection between the tilt-trim system 120 and the tilt-trim buttons 121, as well as the positioning of the tilt-trim buttons 121, are described in more detail below.

Referring back to FIG. 1, the marine outboard engine 100 further includes a cowling 124 that covers the internal combustion engine 102 and the exhaust housing 105. The cowling 124 includes an affixed panel 126 covering the left lateral side of both the internal combustion engine 102 and the exhaust housing 105, and a service panel 128 (FIGS. 3 and 5) covering the right lateral side of both the internal combustion engine 102 and the exhaust housing 105. For simplicity, the lateral left side and the lateral right side will be referred to below as "left side" and "right side", respectively.

Figure 6:
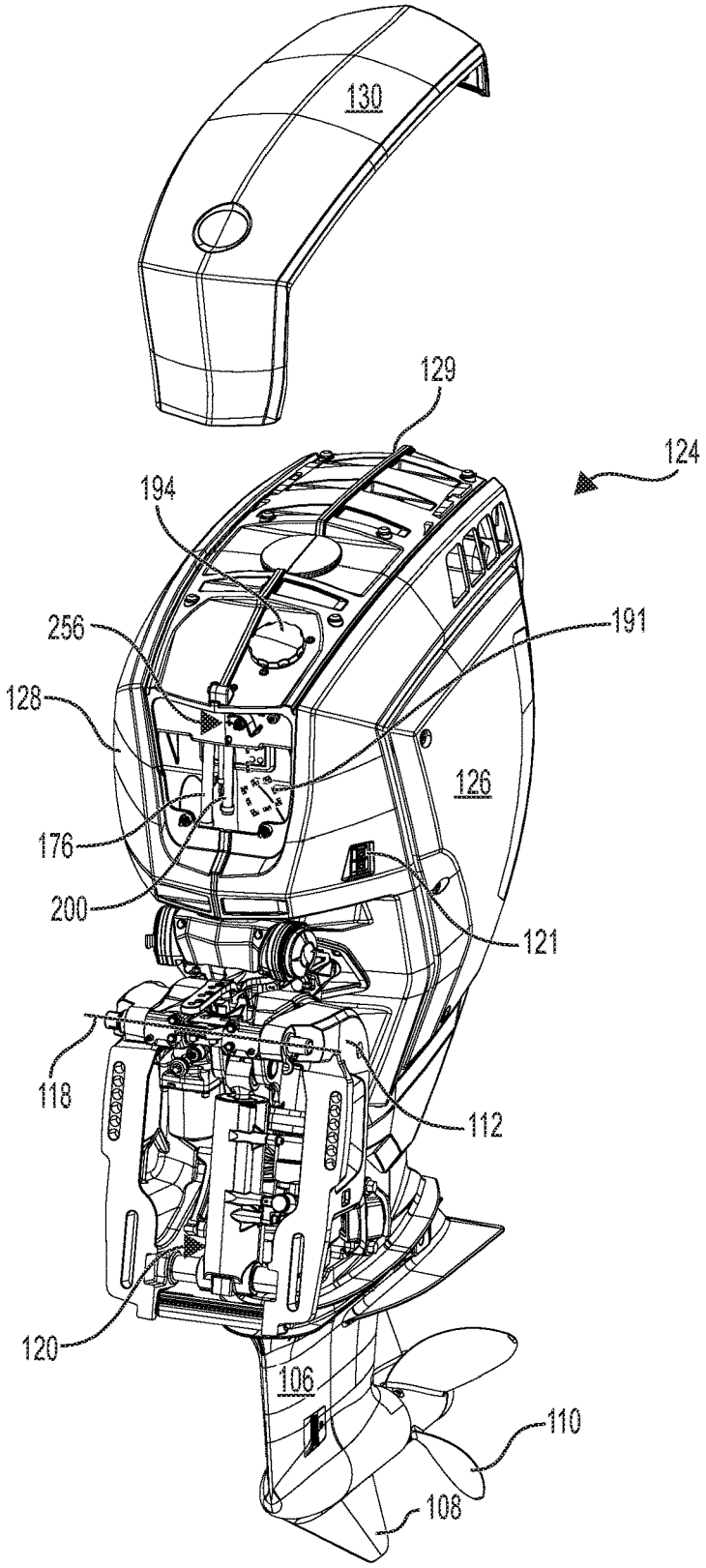
FIG. 6 is a top, front, left side perspective view of the marine outboard engine of FIG. 1 with a top cap of the cowling being detached.

Briefly referring to FIG. 6, the affixed and service panels 126, 128 are bolted to each other and define a split line 129 therebetween. The split line 129 at the top of the affixed and service panels 126, 128 is covered by a top cap 130 of the cowling 124. The top cap 130 clips onto the affixed and service panels 126, 128 to cover part of the split line 129. It is contemplated that a different mounting could be used to attach the top cap 130 to the affixed and service panels 126, 128. When installed, the top cap 130 also covers parts of the front, top and back sides of both the affixed panel 126 and the service panel 128.

Figure 5:
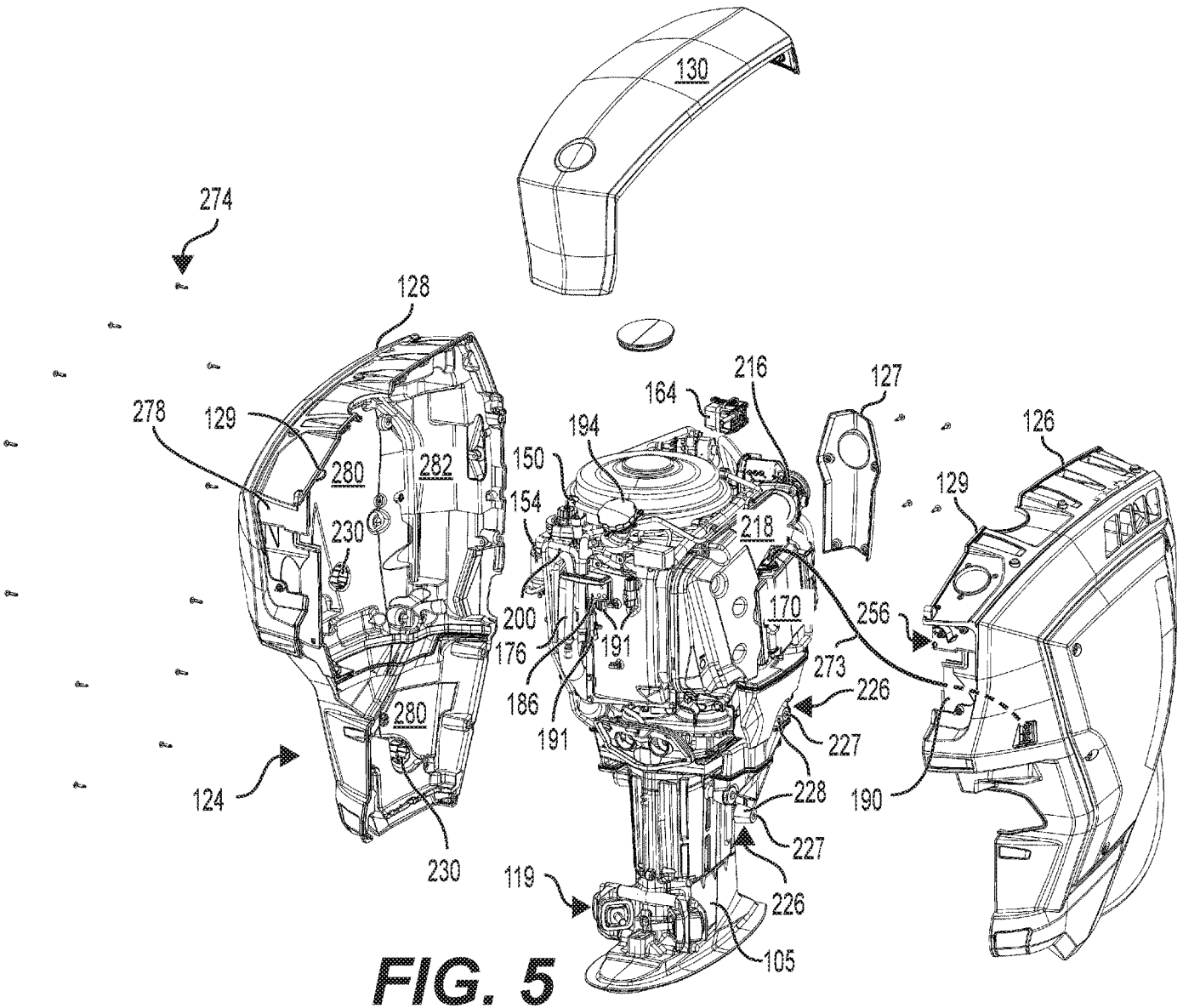
FIG. 5 is a top, front, left side perspective view of the marine outboard engine of FIG. 1 with the cowling shown disassembled.

Briefly referring to FIG. 5, the split line 129 at the rear of the affixed and service panels 126, 128 is covered by a rear seam cover 127. In the present embodiment, the rear seam cover 127 is bolted to the outer back side of the affixed and service panels 126, 128 after the service panel 128 is attached to the affixed panel 126. It is contemplated that a different mounting could be used to attach the rear seam cover 127 to the affixed and service panels 126, 128. The rear seam cover 127 is symmetric about the vertical longitudinal center plane 131 of the internal combustion engine 102, but this need not be the case.

As will be described in more detail below, the cowling 124 and the components covered thereby are arranged to make it easier to inspect and/or service at least some components of the internal combustion engine 102 that require regular servicing and/or check-ups (for convenience, referred to below as "regular maintenance components"), while making it more difficult to access at least some of the other components of the internal combustion engine 102 (for convenience, referred to below as "other components").

Figure 2:
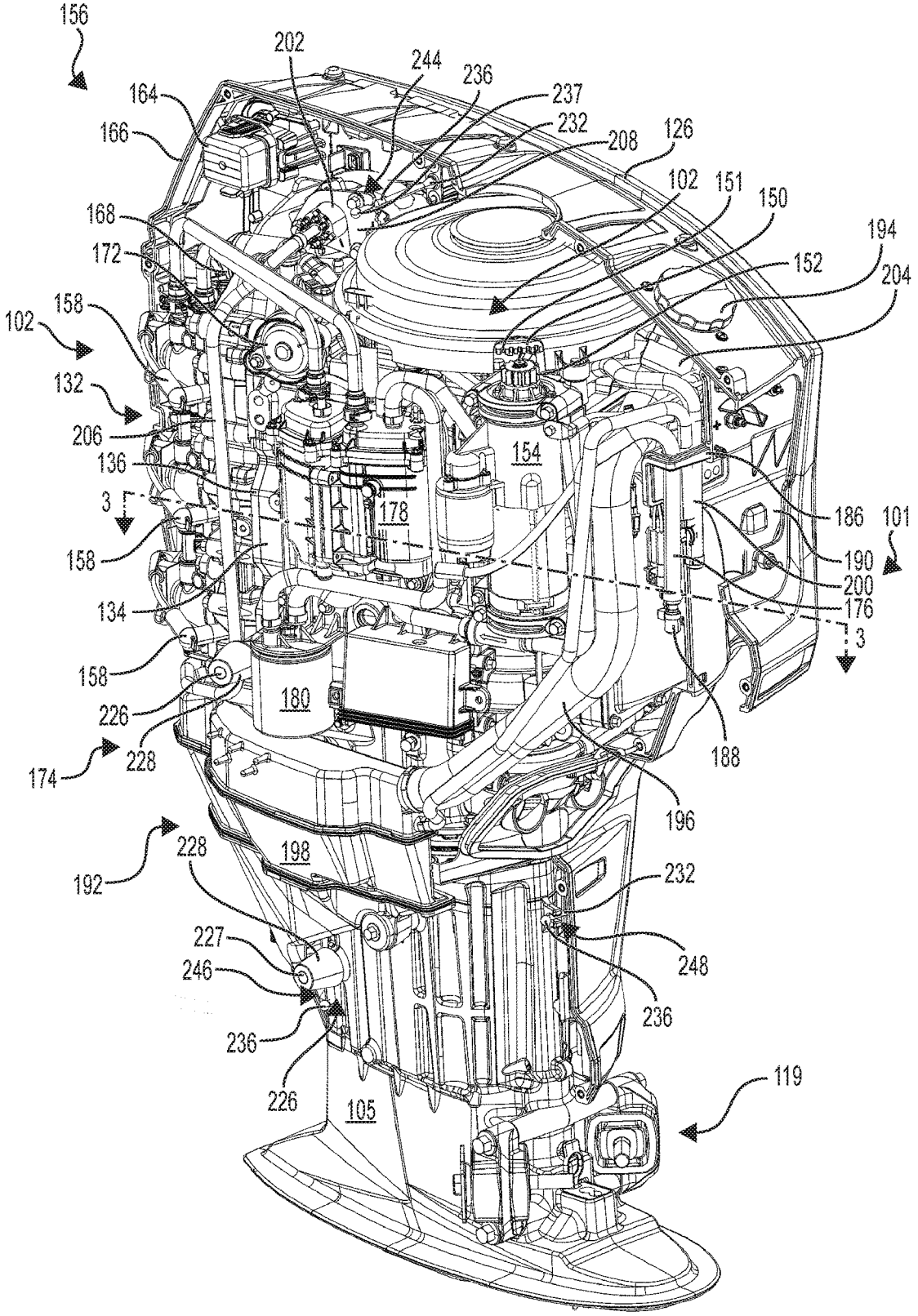
FIG. 2 is a top, front, right side perspective view of the marine outboard engine of FIG. 1 with a service panel removed

More particularly, and referring to FIG. 2, the regular maintenance components are positioned on the right side of the internal combustion engine 102 under the service panel 128. These components are visible and accessible when the service panel 128 is detached and removed from the affixed panel 126 with the affixed panel 126 remaining on the left side of the internal combustion engine 102 as shown in FIG. 2. As described in more detail below, some of the regular maintenance components are positioned along a rear edge 166 of the affixed panel 126 which defines the split line 129. The regular maintenance components are therefore both visible and accessible when the service panel 128 is detached and removed from the affixed panel 126 with the affixed panel 126 remaining on the left side of the internal combustion engine 102.

Further, to simplify removal of the service panel 126, components of the outboard engine 100 that connect or otherwise engage both the internal combustion engine assembly 101 and the cowling 124 (for example by wire, hose or the like) are connected, mounted or extended through the affixed panel 126 and, as such, do not need to be disconnected to enable access to the regular maintenance components. In addition, to discourage needless access to the other components, the other components are positioned on the left side of the internal combustion engine 102 under the affixed panel 126, between the affixed panel 126 and the internal combustion engine 102. To this end, and as described in more detail below, the affixed panel 126 is mounted to be relatively more difficult to remove from the internal combustion engine 102 than the service panel 128. In addition to discouraging needless access to the other components, the relatively more permanent nature of the affixed panel 126 assists technicians in assembling the marine outboard engine 100 by making it easier to connect various engine components to the affixed panel 126 as a result of not having to manually hold the affixed panel 126 in place. Additionally, some of the other components are mounted to the affixed panel 126 instead of being mounted to the internal combustion engine 102. This helps reduce vibration transmitted from the internal combustion engine 102 to these components.

Figure 3:
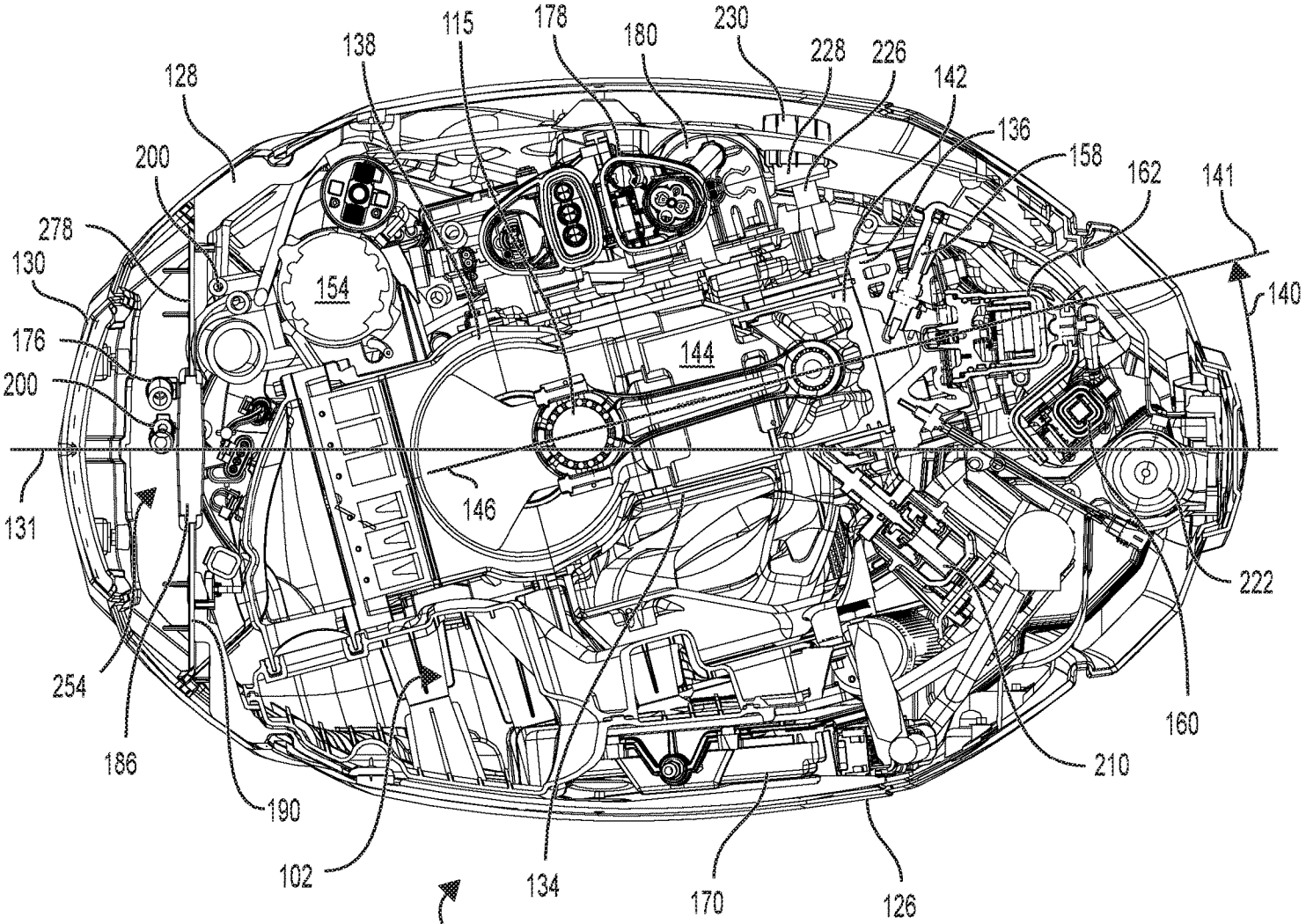
FIG. 3 is a sectional view of the marine outboard engine of FIG. 1, taken through section line 3-3 of FIG. 2.

Referring to FIG. 3, it is contemplated that in alternative embodiments, the affixed panel 126 and the service panel 128 could be mirrored relative to a vertical longitudinal center plane 131 of the marine outboard engine 100. In such embodiments, the panel on the right side of the internal combustion engine 102 would be the "affixed panel", and the panel on the left side of the internal combustion engine 102 would be the "service panel". In such embodiments, the regular maintenance components would be positioned on the left side of the internal combustion engine 102 under the service panel, and the other components would be positioned on the right side of the internal combustion engine 102 under the affixed panel.

Now referring to FIGS. 2 and 3, the internal combustion engine 102 and its components, starting from the right and front sides of the internal combustion engine 102, will be described in more detail. The internal combustion engine 102 includes an engine block 132. The engine block 132 includes a cylinder block 134, a cylinder head 136, and a crankcase 138. The cylinder block 134 is disposed between the cylinder head 136 and the crankcase 138, with the cylinder head 136 being the rearmost part of the engine block 132.

Referring to FIG. 3, the cylinder block 134 and the cylinder head 136 define three vertically-in-line cylinders 144 therebetween. It is contemplated that a different number and/or arrangement of cylinders could be used. Each of the cylinders 144 defines a central axis 146 and has a piston 142. Each of the pistons 142 reciprocates along its respective central axis 146. In the present embodiment, a vertical bank plane 141 passes through the central axis 146 of each cylinder 144. The reciprocating pistons 142 connect to and drive the vertical crankshaft 115 of the internal combustion engine 102. As shown, the crankshaft 115 is disposed inside the crankcase 138.

As best shown in FIG. 3, the cylinder block 134 is angularly offset from the vertical longitudinal center plane 131 of the marine outboard engine 100 by a bank angle 140. The bank angle 140 is defined between the vertical bank plane 141 and the vertical longitudinal center plane 131. The bank angle 140 is selected such that a majority of the cylinder head 136 is disposed on a same side of the vertical longitudinal center plane 131 as the service panel 128. In the present embodiment, the bank angle 140 is fifteen degrees, but it is contemplated that the bank angle 140 could be different in magnitude.

Referring back to FIG. 2, a flywheel/magneto 150 is located on top of the engine block 132. The flywheel portion 151 of the flywheel/magneto 150 is connected directly to a top end of the crankshaft 115 to be driven thereby. The flywheel portion 151 of the flywheel/magneto 150 has a toothed outside circumference that is selectively engaged by a pinion gear 152 driven by a starter motor 154 to rotate the flywheel portion 151 to crank and start the internal combustion engine 102. More particularly, when the starter motor 154 is activated, the pinion gear 152 extends upward to engage and rotate the flywheel portion 151, thereby cranking and starting the internal combustion engine 102.

The flywheel/magneto 150 is part of and powers an electrical system 156 that enables and controls operation of the marine outboard engine 100 during operation. Briefly referring to FIG. 4, part of the electrical system 156 is an Engine Management Module (EMM) 170. The EMM 170 requires inspection relatively less frequently than some of the other engine components. Therefore, the EMM 170 is positioned on the left side of the internal combustion engine 102 under the affixed panel 126. This discourages needless access to the EMM 170.

Referring to FIGS. 2 and 3, the spark plugs 158 are also part of the electrical system 156. In the present embodiment, there are three spark plugs 158, one for each of the three cylinders 144. As shown in FIG. 3, each of the spark plugs 158 is received in a corresponding aperture defined through the right side of the cylinder head 136 and extends into a respective one of the cylinders 144. In the present embodiment, the spark plugs 158 are disposed between the bank plane 141 and the service panel 128. The spark plugs 158 are therefore visible and accessible when the service panel 128 is detached and removed from the affixed panel 126. Each of the spark plugs 158 is electrically connected to a respective ignition coil 160 which is mounted to the cylinder head 136 on the right side of the internal combustion engine 102.

As shown in FIG. 3, the ignition coils 160 are mounted proximate to the rear edge 166 of the affixed panel 126, and therefore proximate to the split line 129, so as to be visible and accessible when the service panel 128 is detached and removed from the affixed panel 126. The ignition coils 160 are disposed between the bank plane 141 and the vertical longitudinal center plane 131. In the present embodiment, the ignition coils 160 and the spark plugs 158 are on opposite sides of the vertical bank plane 141. It is contemplated that one or more of the ignition coils 160 could be mounted to the affixed panel 126, proximate to the rear edge 166 to provide for the visibility and accessibility as described above. The ignition coils 160 send electrical impulses to the respective ones of the spark plugs 158 to generate sparks that ignite the fuel injected into the respective ones of the cylinders 144 by respective ones of fuel injectors 162.

Also part of the electrical system 156 is a fuse assembly 164 (FIG. 2). The fuse assembly 164 contains fuses and relays (not shown) which protect and enable operation of the various components of the electrical system 156. As shown in FIG. 2, the affixed panel 126 includes a baffle 167 along its inner side and to which the fuse assembly 164 is mounted at a top back side thereof. The fuse assembly 164 is thereby located proximate to the rear edge 166 of the affixed panel 126, at a top part of the rear edge 166. More particularly, the fuse assembly 164 is disposed near a top, rear corner of the affixed panel 126, above the engine block 132 and between the bank plane 141 and the vertical longitudinal center plane 131. Mounting the fuse assembly 164 to the baffle 167 reduces vibration received by the fuse assembly 164 from the internal combustion engine 102 during operation.

The position of the fuse assembly 164 relative to the affixed panel 126 makes the fuse assembly 164 visible when the service panel 128 is detached and removed from the affixed panel 126 with the affixed panel 126 remaining on the left side of the internal combustion engine 102. The position of the fuse assembly 164 relative to the affixed panel 126 also makes the fuse assembly 164 accessible for inspecting and/or replacing the fuses and/or relays, when the service panel 128 is detached and removed from the affixed panel 126 with the affixed panel 126 remaining on the left side of the internal combustion engine 102. In some embodiments, the fuse assembly 164 is mounted to the internal combustion engine 102 on the same side as the service panel 128 so as to at least provide the accessibility aspect described directly above.

Still referring to FIG. 2, an engine cooling circuit thermostat 168 is positioned at a top rear part of the engine block 132. This position makes the engine cooling circuit thermostat 168 visible and accessible from the right side of the internal combustion engine 102 when the service panel 128 is detached and removed from the affixed panel 126 with the affixed panel 126 remaining on the left side of the internal combustion engine 102. The engine cooling circuit thermostat 168 is part of a cooling circuit (not shown) of the internal combustion engine 102. Also part of the cooling circuit is an engine cooling circuit blow off valve 172 for releasing fluid from the cooling circuit in case overpressure thereof occurs. The engine cooling circuit blow off valve 172 is positioned on the top, rear, right side of the internal combustion engine 102, forward of the thermostat 168.

A fuel system 174 of the marine outboard engine 100 is described next, with reference to FIGS. 2 and 3. The fuel system 174 includes fuel injectors 162, a fuel supply hose 176, a fuel pump and vapor separator assembly 178, and a fuel filter 180 connected to the fuel pump and vapor separator assembly 178 via respective fuel hoses (not separately labeled). Each of these fuel system components is positioned on the right side of the internal combustion engine 102 and are visible and accessible when the service panel 128 is detached and removed from the affixed panel 126. In operation, fuel flows from an external tank (not shown) via the fuel supply hose 176 to the fuel pump and vapor separator assembly 178, and then to the fuel injectors 162 via the fuel filter 180. Some of the fuel supplied to the fuel injectors 162 is recirculated back to the fuel pump and vapor separator assembly 178. Each of these fuel system components is described next, in order.

As shown in FIG. 3, the fuel injectors 162 are connected to the cylinder head 136 and are disposed on the right side of the vertical longitudinal center plane 131 as a result of the bank angle 140, and are positioned at a back side of the engine block 132. This relative positioning of the fuel injectors 162 with respect to the vertical longitudinal center plane 131 provides service access thereto when the service panel 128 is detached and removed from the affixed panel 126 with the affixed panel 126 remaining on the left side of the internal combustion engine 102.

The fuel supply hose 176 is fluidly upstream of the fuel pump and vapor separator assembly 178. A front part of the fuel supply hose 176 is received through a grommet (not separately labeled) in a rigging grommet bracket 186 and terminates at a quick-connect fitting 188. In some embodiments, the fuel supply hose 176 is attached to the outer side of the affixed panel 126. In some embodiments, the fuel supply hose 176 is mounted to the right side of the internal combustion engine assembly 101. In some embodiments, the fuel supply hose 176 is mounted to the affixed panel 126 proximate the split line 129. In some cases, such positioning improves access to the fuel supply hose 176.

The affixed panel 126 includes a left rigging panel 190 that is attached along a front side thereof. The rigging grommet bracket 186 is L-shaped and is friction fitted into a congruously shaped slot 187 (FIG. 7A) defined in the left rigging panel 190. As shown in FIG. 2, the rigging grommet bracket 186 stays with the left rigging panel 190 at the front of the affixed panel 126 when the service panel 128 is detached and removed from the affixed panel 126 with the affixed panel 126 remaining on the left side of the internal combustion engine 102.

The quick-connect fitting 188 on the outer end of the fuel supply hose 176 allows an external fuel tank (not shown) provided with a hose having a corresponding quick-connect fitting (not shown) to be fluidly connected to the quick-connect fitting 188 to supply fuel to the fuel pump and vapor separator assembly 178. The fuel pump and vapor separator assembly 178 includes a vapor separator (not separately labeled) which stores some of the fuel for removing vapor therefrom. The fuel pump and vapor separator assembly 178 also includes a fuel pump (not separately labeled). The fuel pump supplies fuel from the fuel pump and vapor separator assembly 178 to the fuel injectors 162 via the fuel filter 180 and respective additional fuel hoses.

Still referring to FIG. 2, the internal combustion engine 102 further includes an engine lubrication system 192. The engine lubrication system 192 lubricates various parts of the internal combustion engine 102, as its name implies. The engine lubrication system 192 includes a lubricant filler cap assembly 194, a lubricant filler hose 196, a lubricant reservoir 198, a remote lubricant supply hose 200, and a lubricant pump 202. Lubricant is poured into the lubricant reservoir 198 via the lubricant filler cap assembly 194 and the lubricant filler hose 196, respectively. In cases where an external lubricant supply is connected to the remote lubricant supply hose 200, lubricant is supplied to the lubricant reservoir 198 via the remote lubricant supply hose 200. The lubricant pump 202 supplies lubricant from the lubricant reservoir 198 to various parts of the internal combustion engine 102, as described below. Each of these engine components is described next, in order.

The lubricant filler cap assembly 194 is received through and fixed within an aperture 195 (FIG. 7A) defined through a top of the affixed panel 126 near a front thereof. A lubricant filler cap (not separately labeled) of the lubricant filler cap assembly 194 is disposed on the top of the affixed panel 126 for allowing lubricant to be poured into a lubricant opening (not shown) of the lubricant filler cap assembly 194 when the lubricant filler cap is removed.

A neck portion 204 of the lubricant filler cap assembly 194 is disposed under the top of the affixed panel 126 and directs the lubricant into a top end of the lubricant filler hose 196. The lubricant filler hose 196 directs the lubricant into the lubricant reservoir 198. The remote lubricant supply hose 200 also connects to the lubricant reservoir 198. Similar to the fuel supply hose 176, a front part of the lubricant supply hose 200 is received through a grommet (not separately labeled) in the rigging grommet bracket 186.

The lubricant supply hose 200 can be fluidly connected to a hose from a remote lubricant supply. This connection allows lubricant to be supplied to the lubricant reservoir 198 from the remote lubricant supply. Since the lubricant filler cap assembly 194, lubricant filler hose 196, and the remote lubricant supply hose 200 are all attached to the affixed panel 126, detaching and removing the service panel 128 from the affixed panel 126 for servicing the marine outboard engine 100 does not disturb these elements and the associated fluid connections.

Figure 4:
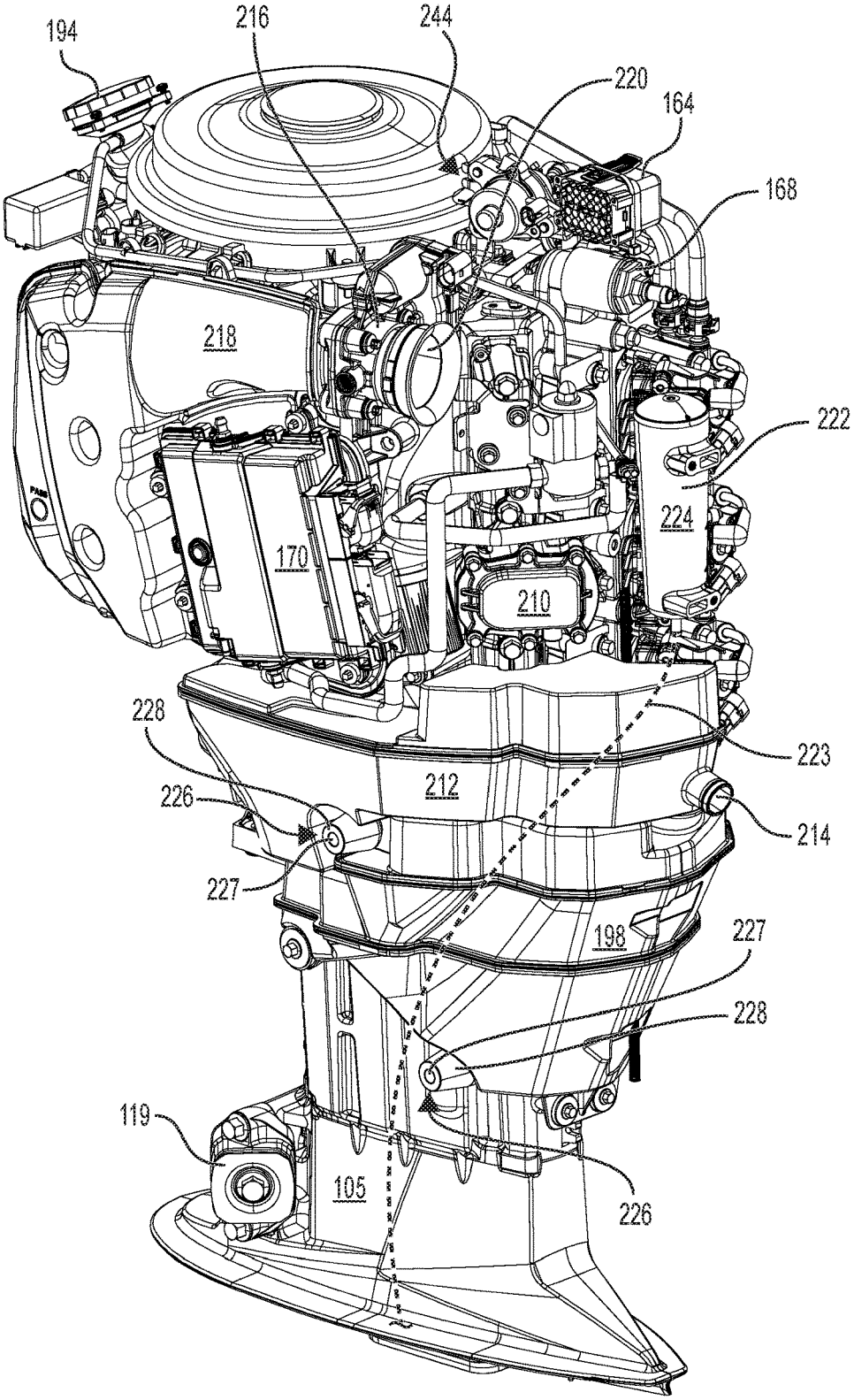
FIG. 4 is a top, rear, left side perspective view of the marine outboard engine of FIG. 1 with a cowling removed.

In the present embodiment, the lubricant reservoir 198 is made of three connected parts (not separately labeled) that are molded from plastic. The lubricant reservoir 198 is attached to a rear portion of the exhaust housing 105 proximate a lower part of the engine block 132. As shown by FIGS. 2 and 4, the lubricant reservoir 198 is U-shaped and wraps around the rear portion of the exhaust housing 105 from a right side of the exhaust housing 105 to the left side of the exhaust housing 105. It is contemplated that a different construction and/or position and/or materials could be used, or that the lubricant reservoir 198 and associated components could be omitted entirely.

Still referring to FIG. 2, the lubricant pump 202 fluidly connects to the lubricant reservoir 198 via a lubricant hose 206 and pumps lubricant from the lubricant reservoir 198 to various parts of the internal combustion engine 102. As an example, the lubricant pump 202 pumps lubricant to the crankcase 138 to lubricate the crankshaft 115. As another example, the lubricant pump 202 pumps lubricant to each of the pistons 142.

In the present embodiment, the lubricant pump 202 is attached to a rear top of the engine block 132 by an inverted-U shaped bracket 208. The position of the bracket 208 relative to the engine block 132 is selected so that the lubricant pump 202 is visible and accessible from the right side of the internal combustion engine 102 when the service panel 128 is detached and removed from the affixed panel 126 with the affixed panel 126 remaining on the left side of the internal combustion engine 102. The lubricant hose 206 is routed from the lubricant reservoir 198 to the lubricant pump 202 on the right side of the internal combustion engine 102 so as to be visible and accessible when the service panel 128 is detached and removed from the affixed panel 126.

Now referring to FIG. 4, the engine components disposed on the rear and left sides of the internal combustion engine 102 are described next in more detail.

To optimize power output, the internal combustion engine 102 is provided with an exhaust valve assembly 210, commonly known as R.A.V.E.™ valve assembly 210, and a muffler 212 on the left side thereof. The muffler 212 wraps in part around the left and back sides of the internal combustion engine 102 and the exhaust housing 105. The muffler 212 has an exhaust pipe 214 that extends rearward out of the cowling 124 and exhausts the exhaust gases from the internal combustion engine 102 when the internal combustion engine 102 is idling or is operated at very low speeds. When the internal combustion engine 102 is operated at moderate to high speeds, exhaust gases are exhausted via an exhaust conduit (not shown) that extends through the exhaust housing 105 and terminates at the propeller 110.

Still referring to FIG. 4, the left side of the internal combustion engine 102 further includes a throttle body 216 and an air intake plenum 218 for bringing air to the cylinders 144 for combustion. The throttle body 216 is positioned vertically above, and in part rearward, of the EMM 170. The throttle body 216 defines an air intake 220 of the internal combustion engine 102. In the present embodiment, the air intake 220 faces rearward. The throttle body 216 fluidly connects the air intake 220 to the air intake plenum 218.

The throttle body 216 controls air supply into the air intake plenum 218 when the internal combustion engine 102 operates. In the present embodiment, the EMM 170 is attached to the air intake plenum 218. The air intake plenum 218 extends in front of and above the EMM 170 on the left side of the engine block 132. The air intake plenum 218 guides air received from the air intake 220 via the throttle body 216 to an air intake manifold (not shown) of the internal combustion engine 102.

Still referring to FIG. 4, the marine outboard engine 100 further includes a remote gearcase lubricant reservoir 222. The gearcase lubricant reservoir 222 fluidly connects to the lubricant-containing cavity 116 (FIG. 1) in the gearcase 106 as schematically shown with a dashed reference line 223 in FIGS. 1 and 4. As the marine outboard engine 100 operates, lubricant in the cavity 116 of the gearcase 106 changes in temperature. When temperature of the lubricant in the cavity 116 rises, the lubricant expands. Any excess lubricant flows up to the gearcase lubricant reservoir 222 via the lubricant hose 223. When temperature of the lubricant in the cavity 116 drops, the lubricant contracts and flows back into the cavity 116.

Figure 7A:
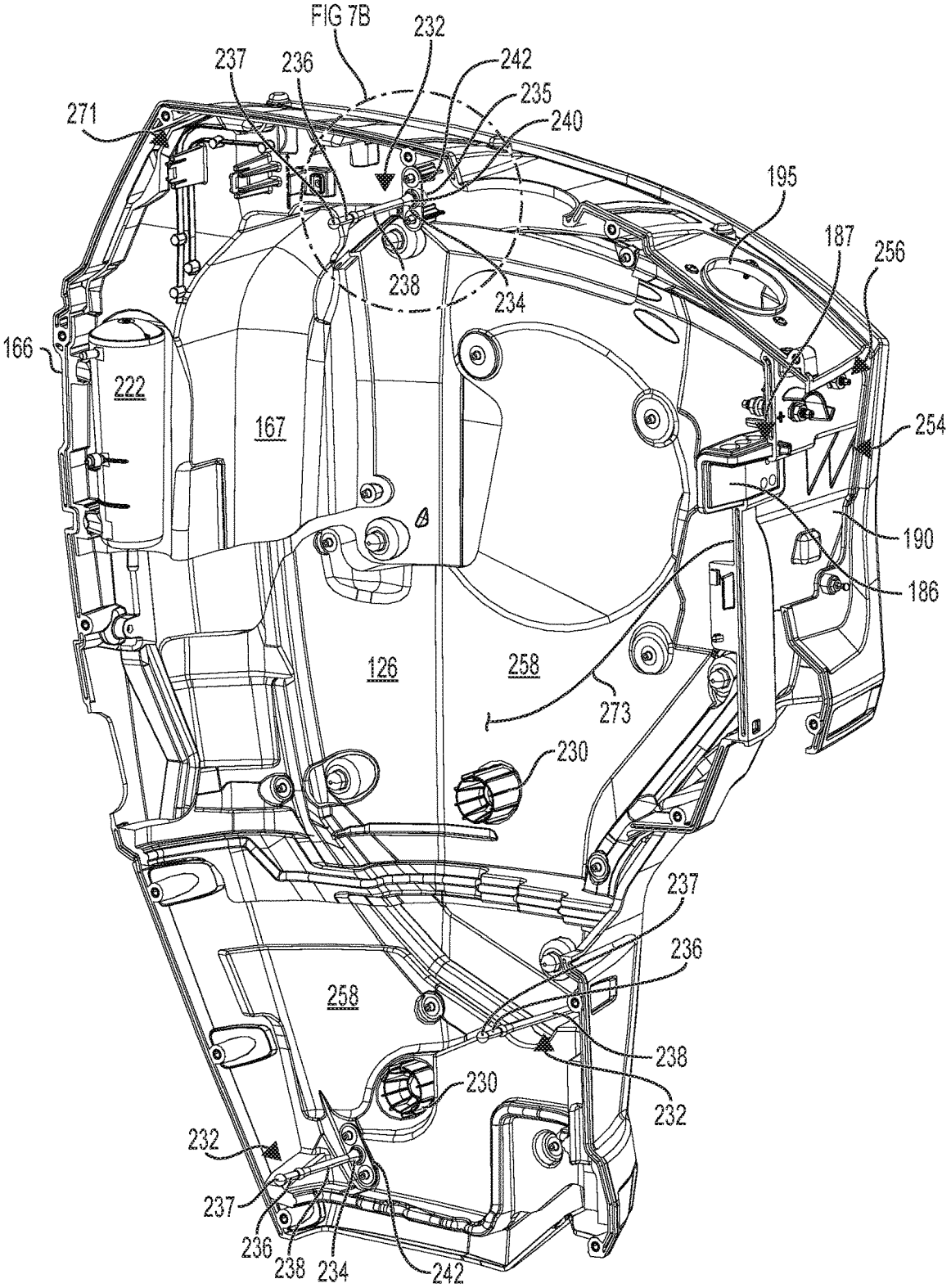
FIG. 7A is a top, front, right side perspective view of an affixed panel of the marine outboard engine of FIG. 1.

Briefly referring to FIG. 7A, the gearcase lubricant reservoir 222 is attached to the affixed panel 126, proximate the rear edge 166 thereof. The gearcase lubricant reservoir 222 is elongate and positioned vertically along the rear edge 166. The gearcase lubricant reservoir 222 is as a result visible and accessible from the right side of the internal combustion engine 102 when the service panel 128 is detached and removed from the affixed panel 126 with the affixed panel 126 remaining on the left side of the internal combustion engine 102.

The gearcase lubricant reservoir 222 is translucent. More particularly, in the present embodiment, a sidewall 224 of the gearcase lubricant reservoir 222 is made of a translucent plastic. Therefore, when the service panel 128 is detached and removed from the affixed panel 126 with the affixed panel 126 remaining on the left side of the internal combustion engine 102, the sidewall 224 is visible and it is thus possible to observe a condition of lubricant that may be contained in the gearcase lubricant reservoir 222.

It is contemplated that a part of the sidewall 224 of the gearcase lubricant reservoir 222 could be translucent or transparent. As an example, it is contemplated that the gearcase lubricant reservoir 222 could have a translucent or transparent observation window in the sidewall 224. In some such embodiments, the gearcase lubricant reservoir 222 is positioned relative to the affixed panel 126 so that the translucent/transparent part/window is visible when the service panel 128 is detached and removed from the affixed panel 126 so as to provide for the lubricant viewing function described above. In some embodiments of the marine outboard engine 100, the gearcase lubricant reservoir 222 is omitted.

The construction of the affixed and service panels 126, 128 and the positioning of the various engine components relative thereto will be described next, in detail. The construction of the affixed and service panels 126, 128 is described in the order of their assembly of the marine outboard engine 100. Hence, the affixed panel 126 is described first.

Referring to FIGS. 5 and 6, the affixed panel 126 is received on the left side of the internal combustion engine 102 and covers all of: the left side of the flywheel/magneto 150, the EMM 170, the left side of the lubricant reservoir 198, the R.A.V.E. valve assembly 210, the left side of the muffler 212, the throttle body 216 and the air intake plenum 218. The affixed panel also covers a majority of the left side of the exhaust housing 105. In the present embodiment, the affixed panel 126 is received on the left side of the internal combustion engine 102 on a pair of resilient engine cover mounts 226. The resilient engine cover mounts 226 position the affixed panel 126 relative to the left side of the internal combustion engine 102. The resilient engine cover mounts 226 also help reduce vibration transmitted from the internal combustion engine 102 to the affixed panel 126. Therefore, each resilient engine cover mount 226 is an example of a damping member. It is contemplated that a different kind of damping members could be used instead of or in combination with the resilient engine cover mounts 226.

As best shown in FIG. 5, an upper one of the resilient engine cover mounts 226 is fixed to and extends outwardly leftward from a lower portion of the engine block 132. A lower one of the resilient engine cover mounts 226 is fixed to and extends outwardly leftward from a middle portion of the exhaust housing 105. In the present embodiment, the resilient engine cover mounts 226 are fixed to the engine block 132 and the exhaust housing 105 via respective ones of post portions 227 of the resilient engine cover mounts 226.

The post portions 227 of the resilient engine cover mounts 226 are cast into the engine block 132 and the exhaust housing 105. It is contemplated that a different construction and/or attachment means of the resilient engine cover mounts 226 to the exhaust housing 105 could be used. To help improve vibration isolation, each of the two resilient engine cover mounts 226 includes a resilient bushing 228 mounted to an outer end of the post portion 227 thereof. The resilient bushings 228 are frustoconical in shape and are made of rubber.

Now also referring to FIG. 7A, the resilient bushings 228 of the resilient engine cover mounts 226 on the left side of the internal combustion engine 102 are matingly received in respective ones of ribbed cylindrical members 230 (FIG. 7A) defined by the affixed panel 126 on an inner side thereof. As shown, the ribbed cylindrical members 230 extend from the inner side of the affixed panel 126 toward the left side of the internal combustion engine 102 and the exhaust housing 105, respectively.

The ribbed cylindrical members 230 receive respective ones of the resilient bushings 228 therein. One such engagement is seen in FIG. 3. Engagement between the inner ribbed surfaces of the ribbed cylindrical members 230 and respective ones of the resilient bushings 228 positions the affixed panel 126 relative to the left side of the internal combustion engine 102 and isolates some of the engine's 102 vibration from the affixed panel 126.

The ribbed cylindrical members 230 are made from the same material as the rest of the affixed panel 126. It is contemplated that different mating shapes and/or materials of the resilient engine cover mounts 226 and the ribbed cylindrical members 230 could be used. It is contemplated that the resilient engine cover mounts 226 could be placed in different positions relative to the internal combustion engine assembly 101 and/or that a different number of resilient engine cover mounts 226 could be used. It is contemplated that the resilient bushings 228 could be omitted. It is also contemplated that the affixed panel 126 could have the resilient engine cover mounts 226 and the exhaust housing 105 could have the ribbed cylindrical members 230.

Returning to FIG. 7A, once the affixed panel 126 is received on the resilient engine cover mounts 226, it is attached to the internal combustion engine assembly 101, and more particularly to the internal combustion engine 102 and the exhaust housing 105, via three resilient rubber cords 232. In the present embodiment, the affixed panel 126 is not bolted or screwed to the internal combustion engine 102 or the exhaust housing 105.

In the present embodiment, one of the three cords 232 is fixed at one end to a top portion of the inner side of the affixed panel 126. A second one of the three cords 232 is fixed at one end to a bottom rear portion of the inner side of the affixed panel 126. A third one of the three cords 232 is fixed at one end to a lower front portion of the inner side of the affixed panel 126, between the first two of the cords 232.

The three cords 232 are all the same and therefore only the construction of the upper one of the cords 232 will be described in detail. The components of the other two cords 232 are labeled with the same reference numerals as the corresponding components of the upper one of the cords 232. Each of the cords 232 is a resilient connector and is an example of what is referred to in the present specification as a panel-to-engine-assembly connector. It is contemplated that a different arrangement and/or number and/or combination of the panel-to-engine-assembly connectors could be used to attach the affixed panel 126 to the internal combustion engine assembly 101.

For example, it is contemplated that one or more of the resilient engine cover mounts 226 could include some means, such as a locking element, for keeping the affixed panel 126 on the internal combustion engine assembly 101 while the service panel 128 is detached and removed therefrom. In such embodiments, the one or more of the resilient engine cover mounts 226 would serve as panel-to-engine-assembly connectors. It is contemplated that a combination of different panel-to-engine-assembly connectors could be used.

Figure 7B:
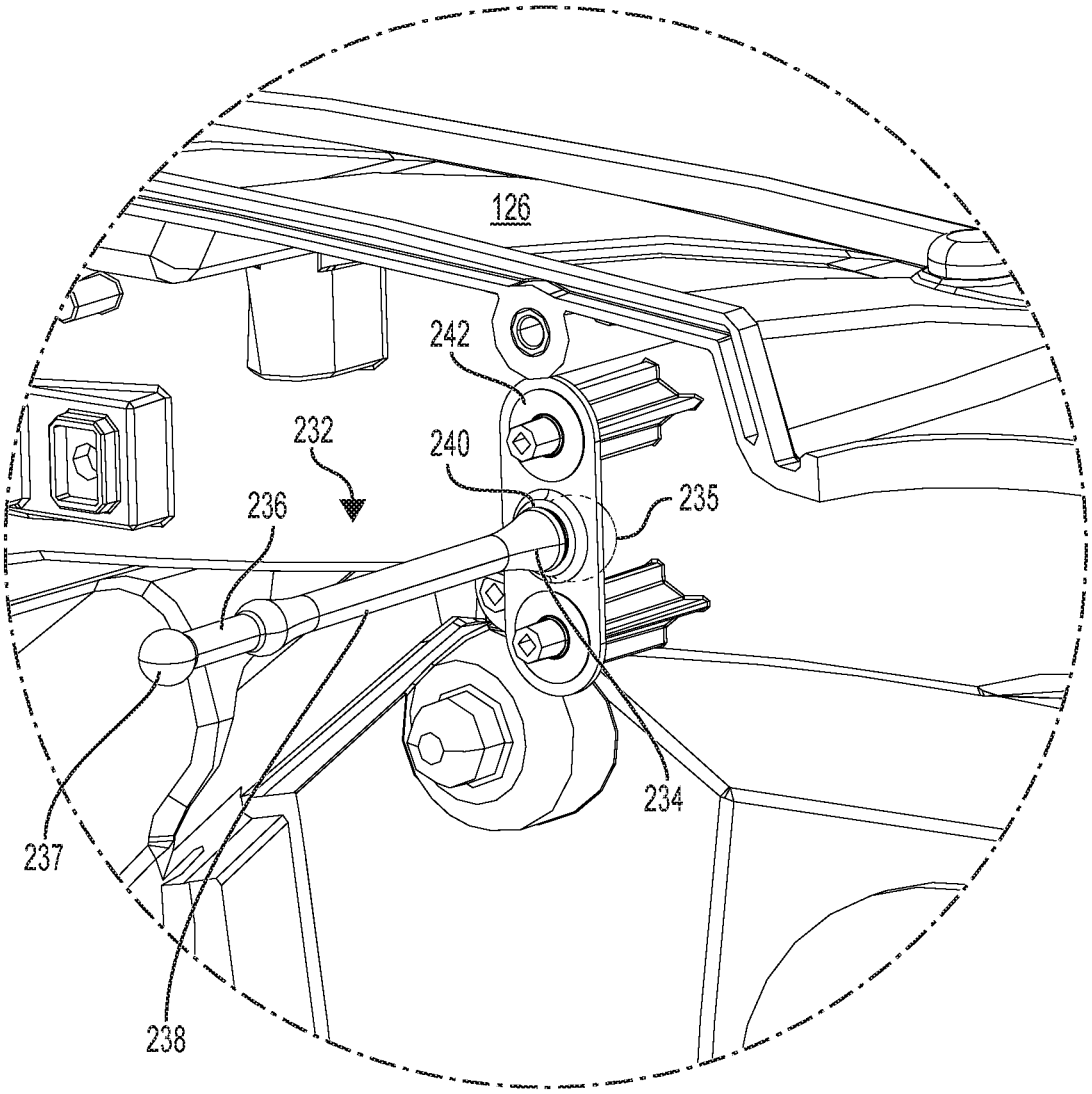
FIG. 7B is a close-up view of a part of the affixed panel of FIG. 7A.

Referring to FIGS. 7A and 7B, the upper cord 232 has a first end portion 234, a second end portion 236, and a mid portion 238 extending between the first and second end portions 234, 236. An end part 235 of the first end portion 234 is formed to have a larger diameter than a diameter of the mid portion 238. The first end portion 234 is removably received in an aperture 240 defined in the affixed panel 126 by the end part 235 having been manually forced therethrough. More particularly, the aperture 240 is defined in a flat metal member 242 that is part of the affixed panel 126 and is bolted to two plastic resilient engine cover mounts (not separately labeled) protruding from the inner side of the affixed panel 126.

As best shown in FIG. 7B, the end part 235 of the first end portion 234 is disposed between the flat metal member 242 and the inner side of the affixed panel 126. The aperture 240 is smaller in diameter than the end part 235. Therefore, the end part 235 engages the aperture 240 when pulled away from the inner side of the affixed panel 126 and thereby holds first end portion 234 in place. It is contemplated that first end portion 234 of the upper cord 232 could be attached to the affixed panel 126 via a different means. It is also contemplated that the aperture 240 could be a recess defined in a side of the flat metal member 242. In such embodiments, the first end portion 234 of the upper cord 235 would be received in the recess by being manually pressed therein from the side of the flat metal member 242.

Still referring to FIGS. 7A and 7B, an end part 237 of the second end portion 236 of the upper cord 232 is formed to have a larger diameter than a diameter of the mid portion 238. Now referring to FIG. 2, after the affixed panel 126 has been placed onto the resilient engine cover mounts 226, the second end portion 236 of the upper cord 232 is stretched away from the inner side of the affixed panel 126 and is then inserted into a recess 244 defined in the inverted-U shaped bracket 208 that holds the lubricant pump 202. The diameter of the end part 237 of the second end portion 236 is larger than a diameter of the recess 244. The end part 237 therefore engages the recess 244 and holds the second end portion 236 in place, against the tension force applied thereto by the stretched portion of the upper cord 232.

Returning to FIG. 2, the second end portions 236 of the other two cords 232 are similarly stretched away from the inner side of the affixed panel 126 and inserted into and engage corresponding recesses 246 and 248. More particularly, the second end portion 236 of the lower rear one of the cords 232 is received in a recess 246 defined in a lower rear portion of the exhaust housing 105. The second end portion 236 of a lower front one of the cords 232 is received in a recess 248 defined in a lower front portion of the exhaust housing 105.

The three cords 232 are thus in tension, engage respective ones of the recesses 244, 246, 248 and thereby hold the affixed panel 126 on the resilient engine cover mounts 226 on the left side of the internal combustion engine 102 while various engine components are being attached to the affixed panel 126 during assembly of the marine outboard engine 100 or after a service of the marine outboard engine 100 requiring removal of the affixed panel 126. The three cords 232 also hold the affixed panel 126 on the resilient engine cover mounts 226 on the left side of the internal combustion engine 102 when the service panel 128 is detached and removed from the affixed panel 126 for servicing the engine components on the right side of the internal combustion engine 102. In at least some cases, this makes the servicing easier.

Reference is now made back to FIGS. 5 to 7 to describe the affixed panel 126 panel in more detail. The affixed panel 126 defines part of a rigging area 254 at a front side thereof, of which the left rigging panel 190 with the rigging grommet bracket 186 are a part. The rigging area 254 is covered by the front of the top cap 130 when mounted to the rest of the cowling 124. In the present embodiment, communication wires 191 that extend from the EMM 170 are attached at their outer ends to the rigging panel 190. In some embodiments, the communication wires 191 are attached to the rigging panel 190 by being passed through additional one or more grommets (not separately labeled) in one or more respective apertures defined through the rigging grommet bracket 186. In some embodiments, the communication wires 191 are attached to the outer side of the affixed panel 126. In some embodiments, the communication wires 191 are mounted to the right side of the internal combustion engine assembly 101. In some embodiments, the communication wires 191 are mounted to the affixed panel 126 proximate the split line 129. In some cases, such positioning improves access to the communication wires 191.

As shown in FIG. 5 and schematically in FIG. 6, the communication wires 191 at their outer ends include quick-connect connectors (not separately labeled). These quick-connect connectors are used to connect to matching quick-connect connectors (not shown) from wires leading from various marine outboard engine controls (not shown) at the helm (not shown) of the watercraft with which the marine outboard engine 100 is used. These "drive-by-wire" controls may include, for example a throttle and a gear shifter (not shown) that communicate over a controller area network (CAN) bus, although it is contemplated that the communication wires 191 may carry analog signals to and/or from the EMM 170.

It is contemplated that any suitable communication wires, including a single wire, and/or any suitable connectors could be used to connect controls to the marine outboard engine 100. In the present embodiment, a length of each communication wire 191 extends past the rigging grommet bracket 186, into the space between the rigging area 254 and the top cap 130. Similarly, a length of each of the fuel supply hose 176 and the remote lubricant supply hose 200 extend past the rigging grommet bracket 186, into the space between the rigging area 254 and the top cap 130.

It is also contemplated that the quick-connect connectors of the communication wires 191, the fuel supply hose 176 and the remote lubricant supply hose 200 could be mounted directly in the left rigging panel, such that the wires 191 and hoses 176 and 200 do not extend beyond the rigging area and that the corresponding wires and hoses from the watercraft are plugged into connectors mounted flush with the left rigging panel 190, a right rigging panel 278 (described below) and/or the rigging grommet bracket 186. It is also contemplated that such connectors could be located under the cowling 124, along the right lateral side of the internal combustion engine assembly 101 or mounted to the affixed panel 126 proximate the split line 129, such that they are accessible when the service panel 128 is detached and removed for servicing the marine outboard engine 100.

In the present embodiment, the left rigging panel 190 also includes battery terminals 256 thereon. The battery terminals 256 are for connecting an external battery (not shown) thereto, for powering the starter motor 154. Having the communication wires 191 and the battery terminals 256 on the left rigging panel 190 allows the communication wires 191 and the electrical wires from the battery terminals 256 to remain undisturbed when the service panel 128 is detached and removed from the affixed panel 126 for servicing the marine outboard engine 100. In some embodiments, the battery terminals 256 are disposed on the outer side of the affixed panel 126. In some embodiments, the battery terminals 256 are mounted to the right side of the internal combustion engine assembly 101 so as to be accessible when the service panel 128 is detached and removed from the affixed panel 126. In some embodiments, the battery terminals 256 are mounted to the affixed panel 126 proximate the split line 129. In some cases, such positioning improves access to the battery terminals 256.

Referring to FIG. 7A, the affixed panel 126 further includes two pieces of acoustic insulation foam 258 and the baffle 167 attached to an inner side thereof. The pieces of acoustic insulation foam 258 are disposed one above the other and conform to the shape of the inner side of the affixed panel 126. It is contemplated that a different acoustic insulation arrangement could be used. As mentioned above, the baffle 167 has the fuse assembly 164 attached thereto. More particularly, the fuse assembly 164 is mounted to the baffle 167 via a pair of clip arms 271. The clip aims 271 removably receive the fuse assembly 164 therebetween. The baffle 167 is molded from plastic, but a different material and/or manufacturing method could be used. It is contemplated that a different mounting means could be used.

Figure 8:
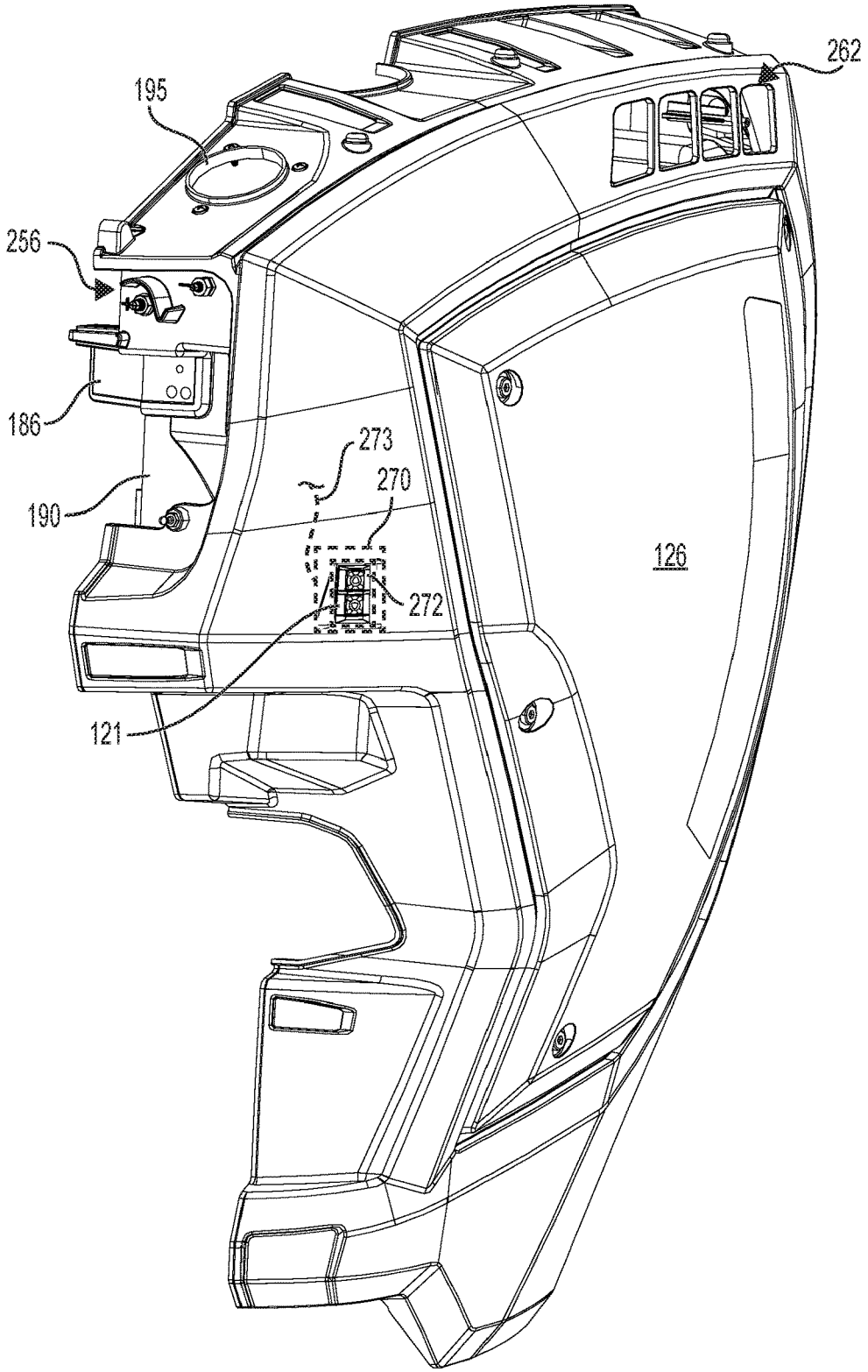
FIG. 8 is a top, front, left side perspective view of the affixed panel of FIG. 7A.
Figure 11:
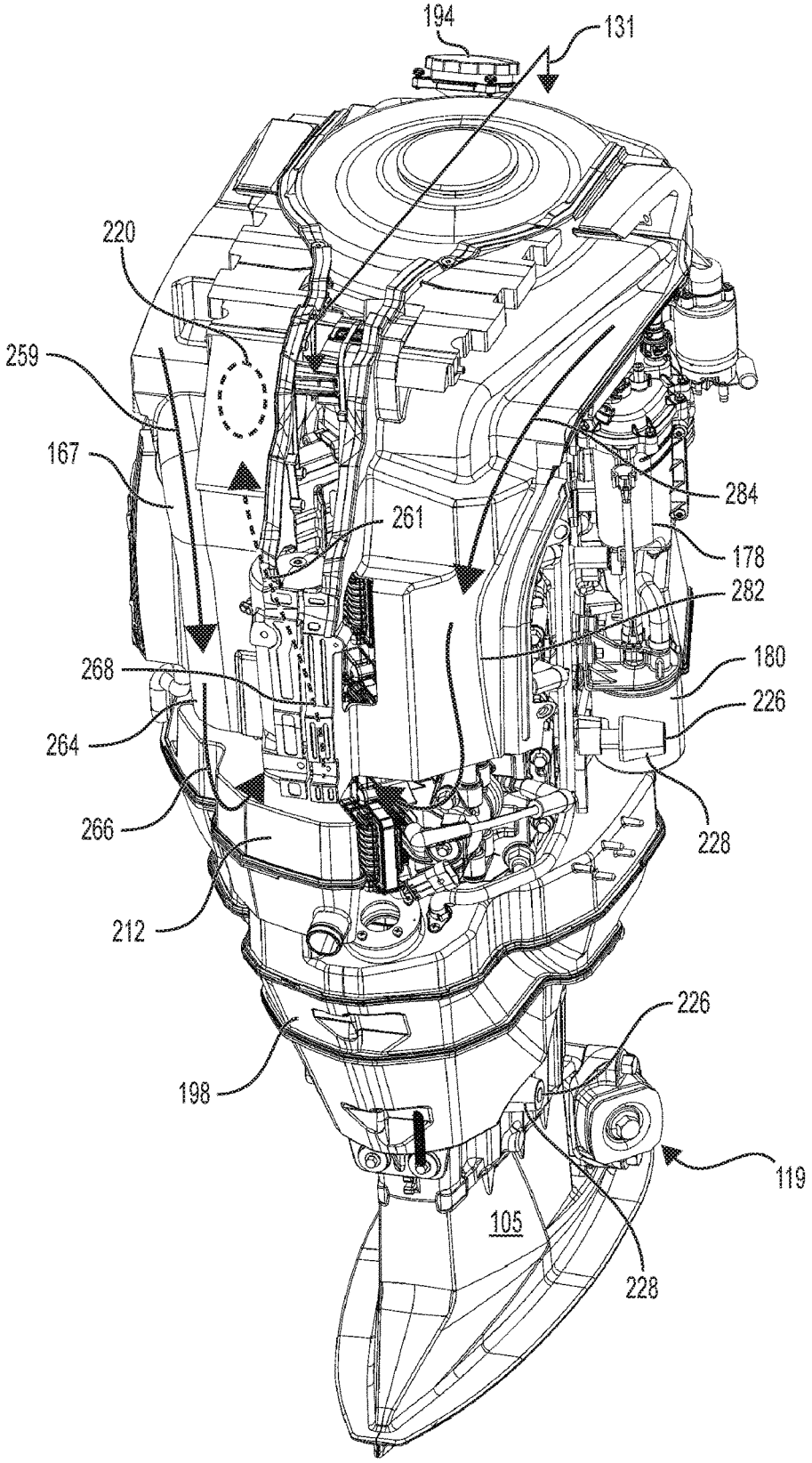
FIG. 11 is a top, rear, right side perspective view of the marine outboard engine of FIG. 1 with the cowling removed and baffles thereof shown.

Referring to FIGS. 8 and 11, the baffle 167 defines a portion 259 of a tortuous air path 261 (FIG. 11) between the baffle 167 and the inner side of the affixed panel 126. The portion 259 of the air path 261 starts at an air intake aperture 262 (FIG. 8) defined at a top rear portion of the affixed panel 126. As shown in FIG. 11, the portion 259 of the air path 261 guides air from the intake aperture 262 downward, along the back side of the internal combustion engine assembly 101.

The air intake 220 is disposed vertically lower than the air intake aperture 262 in the affixed panel 126, but vertically higher than a bottom edge 264 of the baffle 167. As shown in FIG. 11, air from the intake aperture 262, in flowing toward the air intake 220, first flows downward and rearward from the intake aperture 262 along an outer surface of the baffle 167 toward the bottom edge 264 of the baffle 167. The air then turns around the bottom edge 264 of the baffle 167 to flow upward toward the air intake 220, as shown with arrows 266 and 268. At this point, the air flows past engine components that are disposed between the bottom edge 264 of the baffle 167 and the air intake 220 of the internal combustion engine 102.

Now referring to FIG. 8, the outer side of the affixed panel 126 will be described in more detail. As shown, the tilt-trim buttons 121 for operating the tilt-trim system 120 are mounted to a front portion of the outer side of the affixed panel 126. The body of the tilt-trim buttons 121 extends through the affixed panel 126 to the inner side of the affixed panel 126. At an inner side of the body of the tilt-trim buttons 121 is a female electrical quick-connector 270, shown schematically in FIG. 8.

The female electrical quick-connector 270 is disposed on the inner side of the affixed panel 126 and mates with a matching male quick-connector 272, also shown schematically in FIG. 8. The male quick-connector 272 electrically connects the tilt-trim buttons 121 to the EMM 170 via electrical wires 273 for operating the tilt-trim system 120. The electrical wires 273 are disposed on the left side of the internal combustion engine 102, between the EMM 170 and the affixed panel 126. It is contemplated that the male and female connectors 270, 272 could be reversed and could be otherwise located. It is contemplated that any suitable matching quick-connect connectors could be used.

Mounting the tilt-trim buttons 121 on the affixed panel 126 and running the electrical wires 273 on the left side of the internal combustion engine 102, in combination with the cords 232 holding the affixed panel 126 on the left side of the internal combustion engine 102, allows the electrical connection between the tilt-trim buttons 121 and the tilt-trim system 120 to be undisturbed when the service panel 128 is detached and removed from the affixed panel 126 for servicing the marine outboard engine 100.

When the affixed panel 126 needs to be removed for servicing engine components on the left side of the internal combustion engine 102, the male quick-connector 272 of the electrical wires 273 can be detached from the female electrical quick-connector 270 of the tilt-trim buttons 121 by reaching behind the left rigging panel 190 after the service panel 128 has been detached and removed from the affixed panel 126, and pulling it out of the female electrical quick-connector 270. This allows the affixed panel 126 to be removed from the left side of the internal combustion engine 102 without pulling on the electrical wires 273 leading to the EMM 170.

Still referring to FIG. 8, in the present embodiment, the affixed panel 126 has no engine access apertures in its outer side. The affixed panel 126 may therefore be referred to as unitary. Omitting such access apertures in at least some cases makes it easier and quicker to manufacture the affixed panel 126, in comparison with prior art cowlings which had access apertures and which required additional panels to be made to cover the access apertures.

Now referring to FIGS. 2, 5, 6, 9 and 10, the service panel 128 will be described in more detail.

As can be seen from FIGS. 2 and 5, the service panel 128 is received on the right side of the internal combustion engine 102 and covers all of: the right side of the flywheel/magneto 150, the starter motor 154, the right side of the fuse assembly 164, the engine cooling circuit blow off valve 172, the spark plugs 158, the fuel pump and vapor separator assembly 178, the fuel filter 180, the lubricant filler hose 196, the right side of the lubricant reservoir 198, and the lubricant pump 202. The service panel 128 also covers a majority of the right side of the right side of the exhaust housing 105.

In the present embodiment, the service panel 128 is received on the right side of the internal combustion engine 102 on a pair of resilient engine cover mounts 226 with resilient bushings 228. The resilient engine cover mounts 226 on the right side of the internal combustion engine 102 are similar to the resilient engine cover mounts 226 on the left side of the internal combustion engine 102. The resilient engine cover mounts 226 on the right side of the internal combustion engine 102 have therefore been labeled with the same reference numerals as the resilient engine cover mounts 226 on the left side of the internal combustion engine 102 and will not be described in detail.

Figure 9:
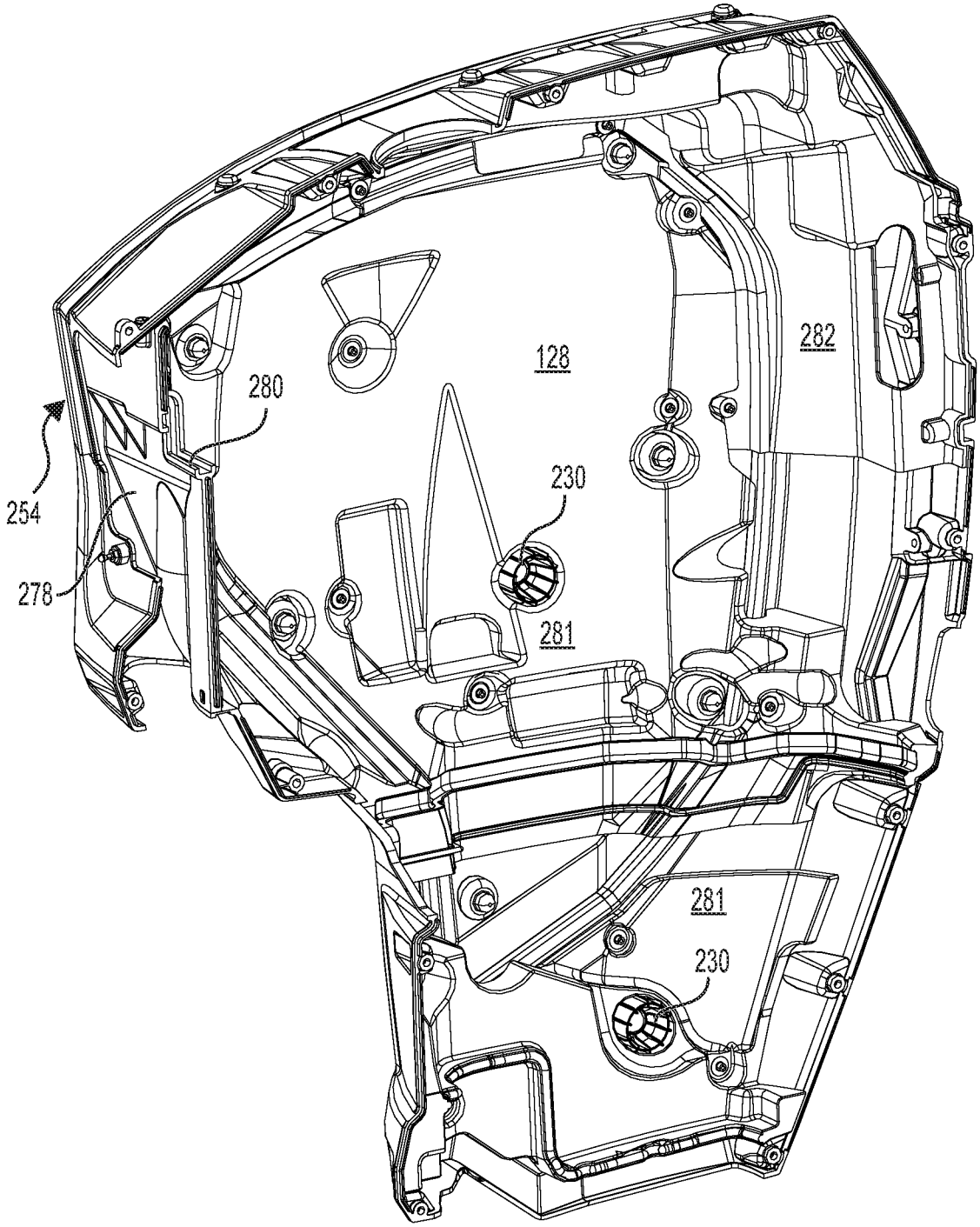
FIG. 9 is a top, front, left side perspective view of the service panel of the marine outboard engine of FIG. 1.

Now referring to FIG. 9, the resilient bushings 228 of the resilient engine cover mounts 226 on the right side of the internal combustion engine 102 are matingly received in respective ones of ribbed cylindrical members 230 defined by the service panel 128 on an inner side thereof. The ribbed cylindrical members 230 of the service panel 128 are similar to the ribbed cylindrical members 230 of the affixed panel 126. The ribbed cylindrical members 230 of the service panel 128 have therefore been labeled with the same reference numerals as the ribbed cylindrical members 230 of the affixed panel 126 and will not be described in detail.

Engagement between the inner surfaces of the ribbed cylindrical members 230 of the service panel 128 and the respective ones of the resilient bushings 228 on the right side of the internal combustion engine 102 positions the service panel 128 relative to the right side of the internal combustion engine 102 and isolates some of the engine's 102 vibration from the service panel 128.

Referring to FIGS. 5 and 6, once the service panel 128 is received on the resilient engine cover mounts 226 on the right side of the internal combustion engine 102, the service panel 128 is bolted to the affixed panel 126. In the present embodiment, the service panel 128 is connected to the affixed panel 126 with bolts 274, received through apertures (not separately labeled, best shown in FIG. 10) defined through the service panel 128 at various locations around an outer perimeter of the service panel 128.

The bolts 274 (FIG. 5) are inserted into and tightened in corresponding threaded apertures (not separately labeled, best shown in FIG. 7A) in the affixed panel 126. The resilient cords 232 holding the affixed panel 126 on the left side of the internal combustion engine 102 assist assembly by holding the affixed panel 126 in place while the bolts 274 are being inserted into the threaded apertures in the affixed panel 126 and tightened.

Each of the bolts 274 is an example of what is referred to in the present specification as a panel-to-panel connector 274. It is contemplated that a different type and/or combination and/or number of the panel-to-panel connectors 274 could be used to removably attach the service panel 128 to the affixed panel 126. Examples of different panel-to-panel connectors 274 include clasps, latches, or the like. Unlike the affixed panel 126, the service panel 128 is not directly attached to the internal combustion engine 102 or the exhaust housing 105.

Returning to FIG. 9, the service panel 128 will now be described in more detail. The service panel 128 defines the other part of the rigging area 254 at a front side thereof. The service panel 128 includes the right rigging panel 278 in the front side thereof. The right rigging panel 278 is fixed to the service panel 128 and defines a slot 280. The slot 280 slidably receives the right side of the rigging grommet bracket 186 therein when the service panel 128 is attached to the affixed panel 126. The right rigging panel 278 thereby sandwiches the rigging grommet bracket 186 against the left rigging panel 190 and keeps it in place.

Still referring to FIG. 9, similar to the affixed panel 126, the service panel 128 also includes two pieces of acoustic insulation foam 281 and a baffle 282, all of which are attached to the inner side of the service panel 128. The two pieces of acoustic insulation foam 281 and the baffle 282 are approximately mirror images of the acoustic insulation foam 258 and the baffle 167 of the affixed panel 126, respectively.

Figure 10:
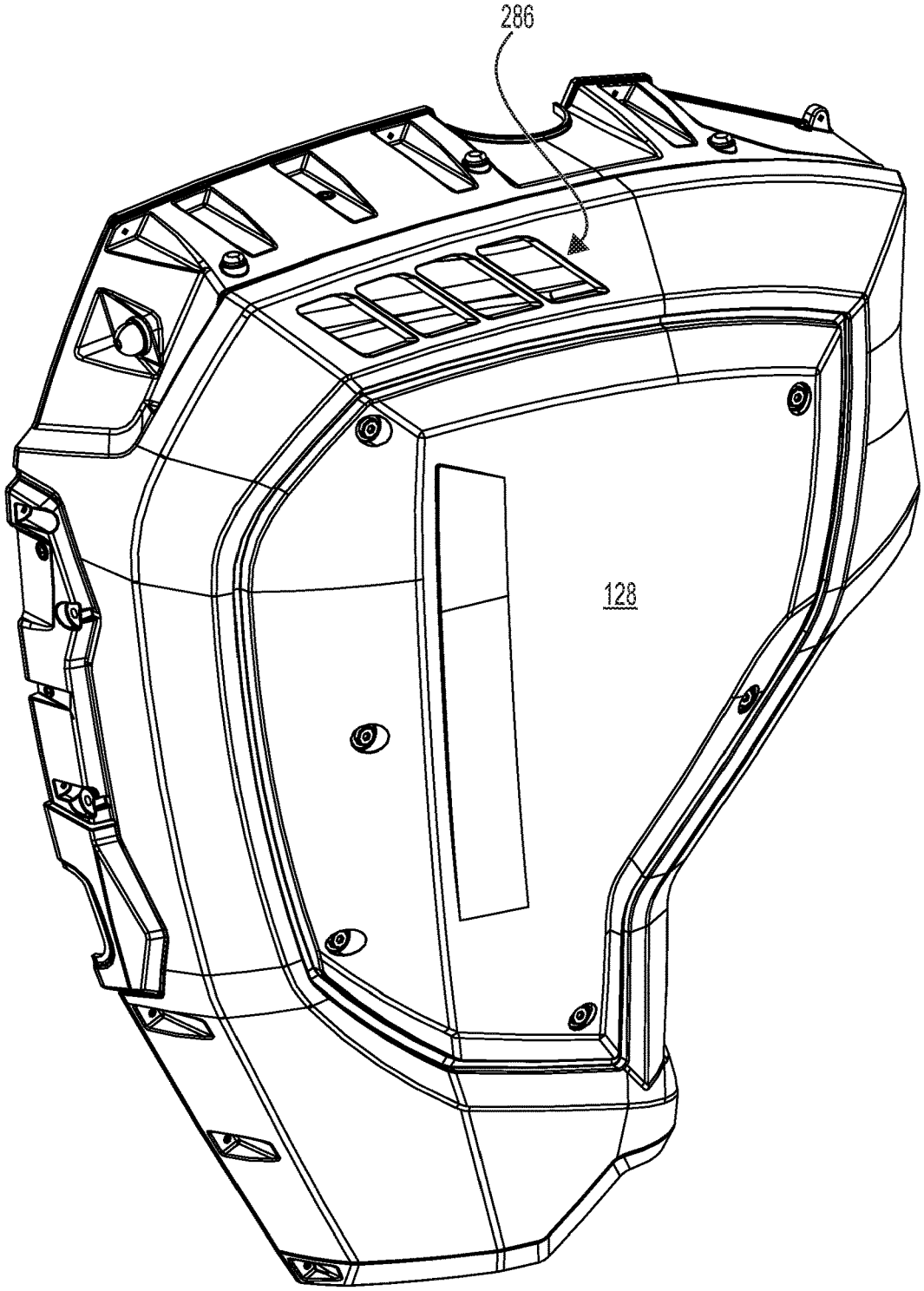
FIG. 10 is a top, rear, right side perspective view of the service panel of FIG. 9.

Referring to FIGS. 10 and 11, the baffle 282 defines another portion 284 of the tortuous air path 261 (FIG. 11) between the baffle 282 and the inner side of the service panel 128. The portion 284 of the air path 261 starts at an air intake aperture 286 (FIG. 10) defined at a top rear portion of the service panel 128. As shown in FIG. 11, the portion 284 of the air path 261 guides air from the air intake aperture 286 toward the air intake 220 of the internal combustion engine 102.

The portion 284 of the air path 261 is similar to the portion 259 of the air path 261 and is therefore not described in detail. As shown in FIG. 11, in the present embodiment, the portions 259, 284 of the air path 261 merge before reaching the air intake 220 of the internal combustion engine 102. It is contemplated that this need not be the case. For example, it is contemplated that the internal combustion engine 102 could have multiple air intakes with a dedicated air path for each one of the multiple air intakes.

As shown in FIG. 11, when the cowling 124 is assembled, the baffles 167 and 282 are disposed on opposite sides of the vertical longitudinal center plane 131 of the internal combustion engine 102 and extend from the top of the internal combustion engine 102 to the back of the internal combustion engine 102. In the present embodiment, the baffles 167 and 282 are positioned approximately symmetrically about the vertical longitudinal center plane 131. It is contemplated that the baffles 167 and 282 could be attached to the engine block 132 or each other instead of the respective ones of the affixed and service panels 126, 128.

As shown in FIG. 10, the service panel 128 has no engine access apertures in its outer side. The service panel 128 may therefore be referred to as unitary. Omitting such access apertures in at least some cases makes it easier and quicker to manufacture the service panel 128, in comparison with prior art cowlings which had access apertures and which required additional panels to be made to cover the access apertures.

Referring to back to FIG. 6, after the affixed and service panels 126, 128 are attached to each other and after the rear seam cover 127 is bolted thereto, the top cap 130 is clipped onto the tops of the affixed and service panels 126, 128 to complete the cowling 124. In contrast to prior art cowlings, the cowling 124 is comprised primarily of two panels split along a vertical, longitudinal central plane, providing a simplified cowling structure and does not require the horizontal split that is common with prior art cowlings.

It is contemplated that any suitable material(s) and manufacturing methods could be used, so long as the functionality described in this document is provided. Modifications and improvements to the above-described embodiments of the present technology may become apparent to those skilled in the art. The foregoing description is intended to be exemplary rather than limiting.

What is claimed is:

1. A marine outboard engine comprising:

an internal combustion engine assembly comprising an internal combustion engine and having a front, a back, a top, a first lateral side, and a second lateral side;

an electrical system operatively connected to the internal combustion engine to operate the internal combustion engine, the electrical system comprising a fuse assembly;

a fuel filter operatively connected to the internal combustion engine to supply fuel to the internal combustion engine from an external fuel tank;

a spark plug connected to the internal combustion engine;

a gearcase including one of a propeller and an impeller operatively connected to the internal combustion engine assembly;

a swivel bracket operatively connected to the internal combustion engine assembly; and a cowling at least partially covering the internal combustion engine assembly, the cowling including:

a service panel disposed on the first lateral side of the internal combustion engine assembly and engaging the first lateral side via at least one first damping member that positions the service panel relative to the first lateral side, and an affixed panel disposed on the second lateral side of the internal combustion engine assembly and engaging the second lateral side via at least one second damping member that positions the affixed panel relative to the second lateral side, the service and affixed panels defining a split line therebetween and being removably attached to each other by a panel-to-panel connector, the fuse assembly, the fuel filter, and the spark plug all being mounted to one of:

the first lateral side of the internal combustion engine assembly, and the affixed panel proximate to the split line, so as to be at least in part accessible from the first lateral side of the internal combustion engine when the service panel is detached and removed from the affixed panel with the affixed panel remaining on the second lateral side of the internal combustion engine.

2. The marine outboard engine of claim 1, wherein the fuse assembly comprises fuses and relays.

3. The marine outboard engine of claim 1, wherein the internal combustion engine assembly further comprises an exhaust housing attached to and extending downward from the internal combustion engine to the gearcase.

4. The marine outboard engine of claim 3, wherein the affixed panel is further connected to the internal combustion engine assembly via a panel-to-engine-assembly connector.

5. The marine outboard engine of claim 4, wherein:

the panel-to-engine-assembly connector is a resilient connector;

the internal combustion engine includes an engine block; and the resilient connector is removably attached to one of: a component of the internal combustion engine, the engine block, the exhaust housing, and the gearcase.

6. The marine outboard engine of claim 5, wherein:

the resilient connector is a rubber cord having first and second end portions and a mid portion extending between the first and second end portions;

part of the second end portion has a first diameter;

the mid portion has a second diameter;

the first diameter is larger than the second diameter;

the first end portion is fixed to the affixed panel;

the second end portion is removably received in one of a recess and an aperture defined in the one of: the component of the internal combustion engine, the engine block, the exhaust housing, and the gearcase;

the first diameter is larger than a diameter of the recess; and the resilient connector is in tension.

7. The marine outboard engine of claim 5, wherein:

the resilient connector is a first resilient connector of a plurality of resilient connectors;

the plurality of resilient connectors includes:

a first resilient connector attached to the front of the internal combustion engine assembly, and a second resilient connector attached to the back of the internal combustion engine assembly.

8. The marine outboard engine of claim 1, wherein:

the internal combustion engine further includes:

a cylinder block, and a cylinder head connected to the cylinder block, the cylinder head and the cylinder block defining a cylinder therebetween;

the spark plug is received in a corresponding aperture defined in the cylinder head and extends in part into the cylinder;

a vertical bank plane defines a bank angle of the cylinder block relative to a vertical longitudinal center plane of the marine outboard engine, the vertical bank plane passing through a central axis of the cylinder; and the spark plug is disposed at least in part between the vertical bank plane and the service panel.

9. The marine outboard engine of claim 1, further comprising an ignition coil operatively connected to the spark plug, wherein the ignition coil is mounted to one of the first lateral side of the internal combustion engine assembly, and the affixed panel proximate to the split line.

10. The marine outboard engine of claim 1, wherein:

the service panel and the affixed panel each include an air intake aperture in a top portion thereof and a baffle;

the internal combustion engine has an air intake; and the baffles define a tortuous air path between each baffle and the respective service panel and the affixed panel, the tortuous air path guiding air from the air intake aperture downward along the back of the internal combustion engine assembly.

11. The marine outboard engine of claim 1, further comprising a first baffle attached to the service panel and a second baffle attached to the affixed panel, wherein:

the first and second baffles are disposed on opposite sides of a vertical longitudinal center plane of the internal combustion engine and extend from the top of the internal combustion engine to the back of the internal combustion engine;

the service panel defines a first air intake aperture in a top portion thereof;

the affixed panel defines a second air intake aperture in a top portion thereof;

the internal combustion engine has an air intake;

the first baffle defines a first portion of a tortuous air path between the first baffle and the service panel, the first portion of the tortuous air path guiding air from the first air intake aperture toward the air intake of the internal combustion engine; and the second baffle defines a second portion of the tortuous air path between the second baffle and the affixed panel, the second portion of tortuous air path guiding air from the second air intake aperture toward the air intake of the internal combustion engine.

12. The marine outboard engine of claim 1, wherein:

the internal combustion engine further includes:

a cylinder block, and a cylinder head connected to the cylinder block, the cylinder head and the cylinder block defining a cylinder therebetween;

the spark plug is received in a corresponding aperture defined in the cylinder head and extends in part into the cylinder;

the cylinder head is angularly offset from a vertical longitudinal center plane of the marine outboard engine by a bank angle; and the bank angle is selected such that a majority of the cylinder head is disposed on a same side of the vertical longitudinal center plane as the service panel.

13. The marine outboard engine of claim 1, further comprising an engine cooling circuit thermostat, an engine cooling circuit blow off valve, an ignition coil, a starter motor, and a vapor separator, wherein the engine cooling circuit thermostat, the engine cooling circuit blow off valve, the ignition coil, the starter motor, and the vapor separator are operatively connected to the internal combustion engine and mounted to one of the first lateral side of the internal combustion engine assembly, and the affixed panel proximate to the split line.

14. The marine outboard engine of claim 1, further comprising a fuel injector operatively connected to the internal combustion engine and mounted to the first lateral side of the internal combustion engine assembly.

15. The marine outboard engine of claim 1, wherein:

the electrical system comprises an Engine Management Module (EMM);

the marine outboard engine further comprises a throttle body operatively connected to the internal combustion engine; and at least one of the EMM and the throttle body is disposed on the second lateral side between the internal combustion engine and the affixed panel.

16. The marine outboard engine of claim 1, further comprising a tilt-trim system coupled to the swivel bracket for adjusting a tilt-trim angle of the internal combustion engine, an Engine Management Module (EMM) operatively connected to the tilt-trim system to operate the tilt-trim system, the EMM being part of the electrical system, and a tilt-trim button operatively connected to the EMM for operating the tilt-trim system via the EMM, wherein the tilt-trim button is on an outer side of the affixed panel.

17. The marine outboard engine of claim 1, further comprising battery terminals operatively connected to a starter motor of the internal combustion engine assembly for connecting a battery thereto, wherein the battery terminals are on an outer side of the affixed panel.

18. A marine outboard engine comprising:

an internal combustion engine assembly comprising and internal combustion engine and having a front, a back, a top, a first lateral side, and a second lateral side;

an electrical system operatively connected to the internal combustion engine to operate the internal combustion engine, the electrical system comprising battery terminals for connecting an external battery to the electrical system;

a gearcase including one of a propeller and an impeller operatively connected to the internal combustion engine assembly;

a swivel bracket operatively connected to the internal combustion engine and coupled to a tilt-trim system for adjusting a tilt-trim angle of the internal combustion engine;

a tilt-trim button operatively connected to the tilt-trim system to operate the tilt-trim system; and a cowling at least partially covering the internal combustion engine, the cowling including:

a service panel disposed on the first lateral side of the internal combustion engine assembly and engaging the first lateral side via at least one first damping member, and an affixed panel disposed on the second lateral side of the internal combustion engine assembly and engaging the second lateral side via at least one second damping member, the service and affixed panels defining a split line therebetween and being removably attached to each other by a connector, the battery terminals being at least one of disposed on an outer side of the affixed panel, mounted to the first lateral side of the internal combustion engine assembly and mounted to the affixed panel proximate the split line, and the tilt-trim button being disposed on the outer side of the affixed panel.

19. The marine outboard engine of claim 18, further comprising a lubricant reservoir mounted to the internal combustion engine assembly, a lubricant hose fluidly connected at one end to the lubricant reservoir, and a lubricant filler cap assembly fluidly connected to another end of the lubricant hose, wherein the lubricant filler cap assembly is attached to the affixed panel.

20. The marine outboard engine of claim 18, further comprising a fuse assembly, a fuel filter, and a spark plug, the fuse assembly being part of the electrical system, the fuel filter being operatively connected to the internal combustion engine to supply fuel to the internal combustion engine from an external fuel tank, the spark plug being connected to the internal combustion engine, wherein:

the fuse assembly and the fuel filter are mounted to one of:

the first lateral side of the internal combustion engine assembly, and the affixed panel proximate to the split line; and the spark plug is mounted to the first lateral side of the internal combustion engine assembly.

21. The marine outboard engine of claim 18, further comprising a fuel supply hose operatively connected via one end to the internal combustion engine for supplying fuel to the internal combustion engine, and at least one communication wire operatively connected via one end to the EMM, wherein the fuel supply hose and the at least one communication wire are at least one of attached to the outer side of the affixed panel, mounted to the first lateral side of the internal combustion engine assembly, and mounted to the affixed panel proximate the split line.

22. The marine outboard engine of claim 21, wherein the affixed panel includes a rigging panel that stays with the affixed panel when the service panel is detached and removed from the affixed panel, and a rigging grommet bracket attached to the rigging panel, wherein:

another end of the fuel supply hose is received through a first aperture defined through the rigging grommet bracket; and another end of the at least one communication wire is attached to the rigging grommet bracket.

23. The marine outboard engine of claim 18, further comprising a gearcase lubricant reservoir fluidly connected to a cavity defined in the gearcase, the cavity containing a lubricant, wherein:

at least a part of the gearcase lubricant reservoir is one of: transparent and translucent;

the gearcase lubricant reservoir is attached to the affixed panel; and at least the part of the gearcase lubricant reservoir is visible when the service panel is detached and removed from the affixed panel with the affixed panel remaining on the second lateral side of the internal combustion engine.

24. The marine outboard engine of claim 18, wherein the cowling further comprises a top cap covering a top portion of the service panel and a top portion of the affixed panel.

25. The marine outboard engine of claim 18, wherein the cowling further comprises a rear seam cover covering at least in part the split line.

* * * * *